US007042425B2

(12) United States Patent
Yamaguchi et al.

(10) Patent No.: US 7,042,425 B2
(45) Date of Patent: May 9, 2006

(54) DISPLAY DEVICE

(75) Inventors: Hisashi Yamaguchi, Nabari (JP); Kyouichi Yamamoto, Soraku-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 323 days.

(21) Appl. No.: 10/255,077

(22) Filed: Sep. 26, 2002

(65) Prior Publication Data

US 2003/0132899 A1 Jul. 17, 2003

(30) Foreign Application Priority Data

Sep. 27, 2001 (JP) ..... 2001-295482
May 30, 2002 (JP) ..... 2002-157356

(51) Int. Cl.
*G09G 3/10* (2006.01)
*G09G 3/30* (2006.01)

(52) U.S. Cl. ..... 345/76; 345/83; 315/169.3

(58) Field of Classification Search ..... 345/55–88, 345/690; 315/169.3
See application file for complete search history.

(56) References Cited

U.S. PATENT DOCUMENTS 5,659,328 A * 8/1997 Todokoro et al. ..... 345/74.1
5,874,933 A * 2/1999 Hirai et al. ..... 345/690
5,982,345 A * 11/1999 Takayama et al. ..... 345/76
6,414,662 B1 * 7/2002 Havel ..... 345/83
6,529,178 B1 * 3/2003 Kimura ..... 345/76
2002/0060525 A1 * 5/2002 Sagano et al. ..... 315/169.3
2004/0164684 A1 * 8/2004 Inukai et al. ..... 315/169.3
2004/0207331 A1 * 10/2004 Koyama ..... 315/169.3

FOREIGN PATENT DOCUMENTS

JP 10-39835 2/1998

* cited by examiner

*Primary Examiner*—Bipin Shalwala
*Assistant Examiner*—David L. Lewis
(74) *Attorney, Agent, or Firm*—Nixon & Vanderhye, PC

(57) ABSTRACT

A display device for realizing gray-scale display by changing an amplitude of a modulation voltage which is output from a data-side driving circuit. A driving control circuit is capable of supplying a first display data signal representing (m+n) grades, obtained by adding m grades represented by a second display data signal externally input and an adjustable range n. The data-side driving circuit is capable of outputting modulation voltages having (m+n) types of amplitudes to a plurality of first electrodes in accordance with a first display data signal. The amplitude of the modulation voltage corresponding to the light emission characteristic of a prescribed light emitting layer among a plurality of light emitting layers is adjusted to an amplitude in the adjustable range n from the amplitude corresponding to the grade represented by the second display data signal.

19 Claims, 17 Drawing Sheets

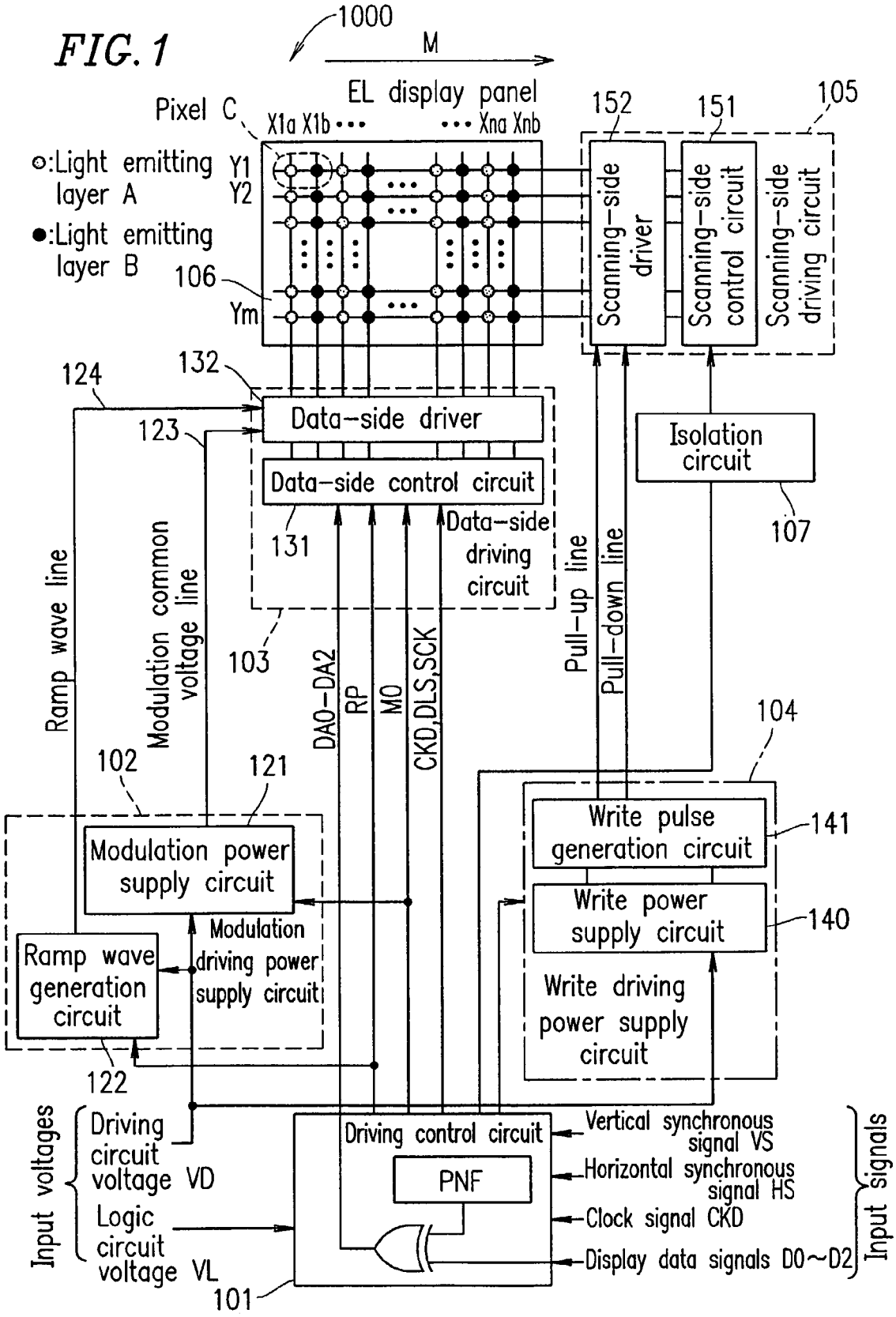
FIG. 1
1000
M
EL display panel
Pixel C
X1a X1b ••• ••• Xna Xnb
⊙:Light emitting layer A
●:Light emitting layer B
Y1
Y2
Ym
106
152
151
105
Scanning-side driver
Scanning-side control circuit
Scanning-side driving circuit
124
132
123
Data-side driver
Data-side control circuit
131
Data-side driving circuit
103
Isolation circuit
107
Ramp wave line
Modulation common voltage line
DA0-DA2
RP
MO
CKD,DLS,SCK
Pull-up line
Pull-down line
104
102
121
Modulation power supply circuit
Ramp wave generation circuit
Modulation driving power supply circuit
122
Write pulse generation circuit
141
Write power supply circuit
140
Write driving power supply circuit
Input voltages
Driving circuit voltage VD
Logic circuit voltage VL
Driving control circuit
PNF
101
Vertical synchronous signal VS
Horizontal synchronous signal HS
Clock signal CKD
Display data signals D0~D2
Input signals

DISPLAY DEVICE

BACKGROUND OF THE INVENTION

1. Field of the Invention

The present invention relates to a capacitive flat matrix display device, and specifically to an inorganic EL (electroluminescence) display device including a plurality of light emitting layers having different light emission characteristics.

2. Description of the Related Art

A display panel of an inorganic EL display device includes a substrate, and a plurality of strip-like first electrodes (data-side electrodes) and a plurality of strip-like second electrodes (scanning-side electrodes) provided on the substrate. The plurality of first electrodes are arranged in parallel to each other, and the plurality of second electrodes are arranged in parallel to each other. The plurality of first electrodes and the plurality of second electrodes are arranged so as to be perpendicular to each other. At each of intersections of the first electrodes and the second electrodes, an inorganic EL element is provided. Each inorganic EL element includes three stacking layers, i.e., an insulating layer formed of a dielectric material, a light emitting layer, and an insulating layer formed of a dielectric material. The inorganic EL elements are provided in a matrix, each acting as a display dot. The display panel includes a plurality of types of light emitting layers so that the color can be changed. An inorganic EL element has the applied voltage vs. luminance characteristics as shown in FIG. 7. The inorganic EL element is driven at a relatively high voltage of about 200 V.

A conventional inorganic EL display device includes a scanning-side driving circuit of a push-pull structure, which includes an output element for applying a negative voltage and an output element for applying a positive voltage both to the scanning-side electrodes. The conventional inorganic EL display device also includes a data-side driving circuit including a source follower-type output element for charging the light emitting layers with a modulation voltage.

The data-side driving circuit uses the charging output element and a discharging output element so as to perform modulation driving. By the modulation driving, the inorganic EL element is charged and discharged in accordance with a display data signal until a modulation voltage of an arbitrary amplitude is obtained. The scanning-side driving circuit uses a switching element such as, for example, a thyristor, so as to perform so-called field inversion driving. Thus, an AC pulse having high symmetry is applied to the light emitting layers, resulting in highly reliable display.

A specific structure of an inorganic EL display device 1000 will be described with reference to FIG. 1. In this example, eight-grade display is provided.

The inorganic EL display device 1000 shown in FIG. 1 includes an EL display panel 106. The EL display panel 106 includes data-side electrodes X1*a*, X1*b*, . . . , Xna and Xnb, and scanning-side electrodes Y1, Y2, . . . , Ym. The data-side electrodes and the scanning-side electrodes are perpendicular to each other. At each of intersections of the data-side electrodes and the scanning-side electrodes, a light emitting layer A or a light emitting layer B is provided in the state of being interposed between two insulating layers. The light emitting layer A has the voltage vs. luminance characteristic shown in FIG. 7 (labeled as "light emitting layer A"), and has a light emitting threshold voltage of VWa and a light emitting saturation voltage of VSa. The light emitting layer B has the voltage vs. luminance characteristic shown in FIG. 7 (labeled as "light emitting layer B"), and has a light emitting threshold voltage of VWb and a light emitting saturation voltage of VSb. The light emitting layer A or the light emitting layer B and two insulating layers interposing the respective light emitting layer act as a display dot. As shown in FIG. 1, a display dot including the light emitting layer A and a display dot including the light emitting layer B are arranged alternately in an M direction. A pixel includes a pair of display dots of these two types.

A driving control circuit 101 is provided in the vicinity of the EL display panel 106. The driving control circuit 101 receives external signals including a vertical synchronous signal VS, a horizontal synchronous signal HS, a data transfer clock signal CKD, and display data signals D0 through D2. The display data signals D0 through D2 exhibit eight grades of luminance. Table 1 shows the relationship between the display data signals D0 through D2 and the luminance. In Table 1, L0 represents the lowest luminance and L7 represents the highest luminance.

TABLE 1

| | Luminance | D2 | D1 | D0 |
|---|---|---|---|---|
| Brightest | L7 | H | H | H |
| . | L6 | H | H | L |
| . | L5 | H | L | H |
| . | L4 | H | L | L |
| . | L3 | L | H | H |
| . | L2 | L | H | L |
| . | L1 | L | L | H |
| Darkest | L0 | L | L | L |

The driving control circuit 101 is operated by a logic circuit voltage VL (e.g., 5 V) which is externally input to the driving control circuit 101.

The driving control circuit 101 generates the following control signals in order to control an operating timing of each of a plurality of portions of the EL display device 1000 in accordance with the input signal. A PN frame signal PNF controls a first frame and a second frame of a display frame. The PN frame signal PNF is "H" in the first frame and is "L" in the second frame. A ramp wave output signal RP controls a ramp wave. A ramp wave is output when the ramp wave output signal RP is "H". A step clock signal SCK equally divides the time period in which the ramp wave output signal RP is "H" into seven. A modulation voltage output signal MO controls a modulation reference voltage pulse. A modulation reference voltage pulse is applied to a modulation common voltage line 123 while the modulation voltage output signal MO is "H". "CKD" refers to a data transfer clock signal as described above, and "DLS" refers to a data latch signal.

In the inorganic EL display device 1000, highly symmetrical AC pulses are applied to the light emitting layers in order to provide highly reliable display. In the first frame, a positive write voltage +(VW+VM) is applied; and in the second frame, a negative write voltage −VW is applied. As such, in the first frame, the amplitude of the modulation voltage needs to be lower as the luminance level is higher, and higher as the luminance level is lower. In the second frame, by contrast, the amplitude of the modulation voltage needs to be higher as the luminance level is higher, and lower as the luminance level is lower. In order to realize this, in the first frame, the display data signal which is input to the driving control circuit 101 is inverted and then is supplied to a data-side driving circuit 103. In the second frame, the display data signal is supplied to the data-side driving circuit 103 without being inverted. Display data signals DA0 through DA2 supplied to the data-side driving circuit 103 are generated by calculating an exclusive-OR of the display data signals D0 through D2 which are input to the driving control circuit 101 and the PN frame signal PNF.

The modulation voltage output signal MO generated by the driving control circuit 101 is supplied to a modulation power supply circuit 121 included in a modulation driving power supply circuit 102. The modulation power supply circuit 121 uses a DC/DC converter or the like to boost a driving circuit voltage VD (e.g., 12 V), which is externally input thereto, to a DC voltage having an amplitude VM (e.g., 35 V). Then, the modulation power supply circuit 121 converts the DC voltage to a modulation reference voltage pulse VMB in synchronization with the modulation voltage output signal MO. The modulation reference voltage pulse VMB obtained by the modulation power supply circuit 121 is output to the modulation common voltage line 123 as a modulation power supply voltage.

The ramp wave output signal RP generated by the driving control circuit 101 is supplied to a ramp wave generation circuit 122 included in the modulation driving power supply circuit 102. In synchronization with a rise of the ramp wave output signal RP, the ramp wave generation circuit 122 starts generating a ramp wave RVM having a peak amplitude VM (e.g., 35 V) from the driving circuit voltage VD. A generated ramp wave RVM is inclined such that the amplitude reaches the peak amplitude VM when the ramp wave output signal RP starts to fall. The ramp wave RVM is returned to a ground GND in synchronization with the fall of the ramp wave output signal RP. The ramp wave RVM generated by the ramp wave generation circuit 122 is output to a ramp wave line 124.

The display data signals DA0 through DA2, the ramp wave output signal RP, the modulation voltage output signal MO, the data transfer clock signal CKD, the data latch signal DLS, and the step clock signal SCK are supplied to a data-side control circuit 131 included in the data-side driving circuit 103. As shown in FIG. 2, the data-side control circuit 131 includes shift register and latch circuits 200 and amplitude control circuits 201. One shift register and latch circuit 200 and one amplitude control circuit 201 are provided for each of the data-side electrodes X1*a*, X1*b*, . . . Xna and Xnb.

The shift register latch circuit 200 receives the data transfer clock signal CKD, the data latch signal DLS, and the display data signals DA0 through DA2. As shown in FIG. 3, each shift register and latch circuit 200 includes three shift registers and three latches. Each shift register receives one of display data signals DA0 through DA2 at a D input terminal and receives a data transfer clock signal CKD at a CLK input terminal. The shift registers and the latches are connected to each other one by one. More specifically, a Q output terminal of a shift register is connected to a D input terminal of the latch. Each latch receives a data latch signal DLS at a CLK input terminal and is connected to the amplitude control circuits 201 (FIG. 2) at a Q output terminal. The Q output terminal of each shift register is also connected to a D input terminal of a shift register in the shift register and latch circuit 200 corresponding to the next data-side electrode.

In the shift register and latch circuits 200, the display data signals DA0 through DA2 (3 bits) are transferred to the respective shift registers in parallel, in synchronization with the data transfer clock CKD. After each horizontal period, data is latched in the latch by the data latch signal DLS. Thus, display data signals DA0(X) through DA2(X) are obtained. Here, (X) refers to one of X1*a*, X1*b*, X2*a*, . . . , Xna and Xnb.

The amplitude control circuit 201 receives the ramp wave output signal RP, the modulation voltage output signal MO and the step clock signal SCK which are generated by the driving control circuit 101, and the display data signals DA0(X) through DA2(X) from the shift register and latch circuits 200. As shown in FIG. 4, the amplitude control circuit 201 includes a counter circuit 220, a decoding circuit 221 and a mask circuit 222.

The counter circuit 220 includes seven flip-flop circuits. Each flip-flop circuit receives a step clock signal SCK at a CLK input terminal and receives a ramp wave output signal RP at a CLR terminal. A Q output terminal of one flip-flop circuit is connected to a D input terminal of the next flip-flop circuit. A /Q output terminal is connected to an input of a corresponding OR circuit. The OR circuits are included in the mask circuit 22. A D input terminal in the leftmost flip-flop circuit is connected to a supply voltage VCC. The counter circuit 220 receives the step clock signal SCK and the ramp wave output signal RP, and outputs signals having seven different pulse widths. The pulses rise at the /Q terminals of the flip-flop circuits at the same timing, and fall at different timings in synchronization with the rise of the step clock signal SCK. The pulse in one flip-flop circuit falls at a later time than the pulse in the flip-flop circuit to the left thereof.

The decoding circuit 221 includes a 3-bit-to-8-line decoder (corresponding to the standard logic 74137). The decoding circuit 221 receives the display data signals DA0 (X) through DA2(X) from the shift register and latch circuit 200 respectively at select input terminals D, E and F, and thus outputs mask signals corresponding to the grades respectively from output terminals W0 through W7. Each mask signal is used for outputting only a signal having a necessary pulse width, among the signals having the seven different pulse widths output from the counter circuit 220, as an RP signal, and masking the other signals. The mask signals from the output terminals W0 through W6 are respectively output to one of two input terminals of the seven OR circuits included in the mask circuit 22. The mask signal from the output terminal W7 is output to one input terminal of an AND circuit 222*a* which is not connected to any output terminal of any OR circuit in the mask circuit 222.

The mask circuit 222 includes AND circuits and OR circuits. Among the signals having seven different pulse widths which are output from the counter circuit 220, a signal having a pulse width corresponding to one of the display data signals DA0(X) through DA2(X) is selected. An output from the mask circuit 222 is output to an AND circuit 201*a* connected to the mask circuit 222. The AND circuit 201*a* also receives the ramp wave output signal RP. Thus, an analog switch control signal MP for controlling a data-side driver 132 included in the data-side driving circuit 103 is generated.

As shown in FIG. 4, the amplitude control circuit 201 includes an other flip-flop circuit. A D input terminal of the flip-flop circuit is connected to the supply voltage VCC. The flip-flop circuit receives a signal obtained by inverting the modulation voltage output signal MO by an inverter at a CLK input terminal. A Q output terminal of the flip-flop circuit is connected to a CLR terminal thereof via three inverters connected in series. Thus, an output from the Q output terminal is received by the CLR terminal in an inverted state. The flip-flop circuit having such a structure generates a ramp wave discharging signal MD from the modulation voltage output signal MO.

The analog switch control signal MP and the ramp wave discharging signal MD which are generated by the amplitude control circuit 201 are supplied to the data-side driver 132. The modulation reference voltage pulse VMB and the ramp wave, which are generated by the modulation driving power supply circuit 102, are also supplied to the data-side driver 132.

As shown in FIG. 2, the data-side driver 132 includes an n-channel FET 300 and a p-channel FET 301 which are connected to each other via sources thereof. The FETs 300 and 301 are respectively connected in parallel to parasitic diodes 302 and 303, thus forming a source follower-type output element. The sources of the FETs 300 and 301 are connected to the data-side electrode X1*a* of the EL display panel 106. A drain of the n-channel FET 300 is connected to the modulation common voltage line 123, which is connected to the modulation driving power supply circuit 102 (FIG. 1). A drain of the p-channel FET 301 is connected to the ground GND. Gates of the FETs 300 and 301 are each connected to a gate capacitor 304 and are also connected to the ramp wave line 124 which is connected to the modulation driving power supply circuit 102 via an analog switch 305.

A gate of the analog switch 305 is controlled by the analog switch control signal MP which is output from the amplitude control circuit 201. When the analog switch 305 is made conductive by the analog switch control signal MP, the potential of the ramp wave is accumulated in the gate capacitor 304. The potential in the gate capacitor 304 is accumulated in the data-side electrode X1*a* as a modulation potential with no alternation. The analog switch control signal MP becomes "H" in a period corresponding to the driving frame and the grade, and the pulse width of the analog switch control signal MP is synchronized with the ramp wave and thus converted into a modulation voltage amplitude.

Tables 2-1 and 2-2 show the relationship between the display data signals D0 through D2 externally input to the inorganic EL display device 1000 and the amplitude level of the output modulation voltage in the first and second frames.

TABLE 2-1

First frame (write voltage: positive)

| PNF | D2 | D1 | D0 | Modulation driving voltage |
|---|---|---|---|---|
| H | H | H | H | 0 V |
| H | H | H | L | 5 V (1/7 VM) |
| H | H | L | H | 10 V (2/7 VM) |
| H | H | L | L | 15 V (3/7 VM) |
| H | L | H | H | 20 V (4/7 VM) |
| H | L | H | L | 25 V (5/7 VM) |
| H | L | L | H | 30 V (6/7 VM) |
| H | L | L | L | 35 V (7/7 VM) |

TABLE 2-2

Second frame (write voltage: negative)

| PNF | D2 | D1 | D0 | Modulation driving voltage |
|---|---|---|---|---|
| L | H | H | H | 35 V (7/7 VM) |
| L | H | H | L | 30 V (6/7 VM) |
| L | H | L | H | 25 V (5/7 VM) |
| L | H | L | L | 20 V (4/7 VM) |
| L | L | H | H | 15 V (3/7 VM) |

TABLE 2-2-continued

Second frame (write voltage: negative)

| PNF | D2 | D1 | D0 | Modulation driving voltage |
|---|---|---|---|---|
| L | L | H | L | 10 V (2/7 VM) |
| L | L | L | H | 5 V (1/7 VM) |
| L | L | L | L | 0 V |

In the first frame, a positive write voltage is applied to the scanning-side electrodes. Therefore, the amplitude of the modulation driving voltage applied to the data-side electrodes is lower as the luminance level is higher, and higher as the luminance level is lower. In the second frame, a negative write voltage is applied to the scanning-side electrodes. Therefore, the amplitude of the modulation driving voltage applied to the data-side electrodes is higher as the luminance level is higher, and lower as the luminance level is lower.

The data-side driver 132 further includes an n-channel FET 306 in parallel to the gate capacitor 304. A gate of the n-channel FET 306 is connected to the ramp wave discharging signal MD. The ramp wave discharging signal MD becomes "H" in a certain period in synchronization with the falling edge of the modulation voltage output signal MO. Then, the FET 306 becomes conductive, and the charge accumulated in the gate capacitor 304 is discharged.

The driving circuit voltage VD which is externally input to the inorganic EL display device 1000 using the DC/DC converter or the like is boosted to +(VW+VM) as a positive DC voltage and −VM as a negative DC voltage by a write power supply circuit 140 included in a write driving power supply circuit 104. The positive and negative DC voltages boosted by the write power supply circuit 140 are supplied to a write pulse generation circuit 141, and are converted into positive and negative pulse-like write voltages in accordance with the control signal supplied from the driving control circuit 101. In this case, "VW" is the light emitting threshold voltage VWa (180 V) of the light emitting layer A, and the driving circuit voltage VD is, for example, 12 V. The write driving power supply circuit 104 outputs 0 V for discharging the write voltage and is placed in a floating state for a period other than write and discharging.

The positive and negative pulse-like write voltages which are generated by the write driving power supply circuit 104 are supplied to a scanning-side driver 152 included in a scanning-side driving circuit 105, respectively via a pull-up line and a pull-down line (FIG. 1). As shown in FIG. 5, the scanning-side driving circuit 105 includes a plurality of switching circuits connected in parallel. The switching circuits are of a push-pull structure and each include a pull-up thyristor 153 and a pull-down thyristor 154. The pull-up line and the Q output terminal have a withstand voltage of about 250 V therebetween, and the Q output terminal and the pull-down line also have a withstand voltage of about 250 V therebetween. The electric potential difference between the pull-up line and the pull-down line changes within a range of about 5 V.

The scanning-side driver 152 is connected to a scanning-side control circuit 151. The scanning-side driver 152 is associated sequentially with the scanning-side electrodes Y1, Y2, . . . , Ym by shift registers (not shown) included in the scanning-side control circuit 151. All the scanning-side electrodes Y1, Y2, . . . , Ym are sequentially scanned. Since the ground potential of the scanning-side control circuit 151 is changed between a positive level and a negative level, the scanning-side control circuit 151 needs to be isolated from the driving control circuit 101. For this purpose, an isolation circuit 107 which includes a photocoupler or the like is provided between the scanning-side control circuit 151 and the driving control circuit 101. Thus, a control signal from the driving control circuit 101 is input to the scanning-side control circuit 151 where the control signal from the driving control circuit 101 and the scanning-side control circuit 151 are isolated from each other.

An exemplary method for driving the inorganic EL display device 1000 having the above-described structure will be described with reference to FIGS. 6A and 6B. In this example, the EL elements at the pixel C (FIG. 1) located at the intersections of the data-side electrodes X1*a* and X1*b* and the scanning-side electrode Y1, i.e., the EL elements (X1*a*, Y1) and (X1*b*, Y1) are caused to emit light at luminance level 6. The light emitting layer A is provided at the intersection of the data-side electrode X1*a* and the scanning-side electrode Y1, and the light emitting layer B is provided at the intersection of the data-side electrode X1*b* and the scanning-side electrode Y1. The light emitting layers A and B are supplied with the same level of voltage. FIGS. 6A and 6B show the waveforms of signals applied to the light emitting layer A. The waveforms of signals applied to the light emitting layer B are omitted.

In the first frame, an exclusive-OR of the display data signals D0 through D2 and the PN frame signal PNF, which are input to the driving control circuit 101, is calculated. As a result, the display data signals D0 through D2 are inverted so as to generate display data signals DA0 through DA2. The display data signals DA0 through DA2 are output to the data-side driving circuit 103.

The data-side driving circuit 103 receives the display data signals DA0 through DA2, the data transfer clock signal CKD, and the data latch signal DLS. The display data signals DA0 through DA2 are transferred to a prescribed position in the shift register and latch circuits 200 (FIG. 2) in the data-side control circuit 131 by the data transfer clock signal CKD. Then, the display data signals DA0 through DA2 are once latched at the rise of the data latch signal DLS. Thus, display data signals DA0(X) through DA2(X) are generated.

All the scanning-side electrodes Y1, Y2, . . . , Ym connected to the scanning-side driving circuit 105 are kept at the floating potential (substantially 0 V). The modulation common voltage line 123 receives the modulation reference voltage pulse VMB in accordance with the modulation voltage output signal MO. The data-side electrodes X1*a*, X1*b*, . . . , Xna and Xnb are each supplied with a modulation voltage of a desired level from the data-side driver 132 in accordance with the analog switch control signal MP and the ramp wave RVM. The analog switch control signal MP is obtained by processing the step clock signal SCK, the ramp wave output signal RP and the display data signals DA0(X) through DA2(X) by the data-side driving control circuit 131. The ramp wave RVM is supplied from the ramp wave line 124.

The data-side driver 132, which is connected to the data-side electrodes X1*a* and X1*b* corresponding to the EL elements (X1*a*, Y1) and (X1*b*, Y1) is charged until the gate capacitor 304 is charged to 1/7VM (5 V), the FET 300 is turned ON, and the data-side electrodes X1*a* and X1*b* are charged to 1/7VM (5 V).

Next, the pulse-like write driving voltage supplied from the write power supply circuit 104, i.e., +(VW+VM) (215 V) is supplied to the selected scanning-side electrode Y1 via the pull-up line and the selected pull-up thyristor 153 in the scanning-side driver 152. Thus, the scanning-side electrode Y1 is charged to +(VW+VM) (215 V).

Therefore, the voltage applied to both of two ends of the EL elements (X1*a*, Y1) and (X1*b*, Y1) is +VW+6/7VM (210 V). This value is obtained as a result of the write driving voltage and the modulation voltage being superimposed on each other. In this case, the EL element (X1*a*, Y1) is caused to emit light at luminance level 6, but the EL element (X1*b*, Y1) is caused to emit light only at about luminance level 4.

After the EL elements (X1*a*, Y1) and (X1*b*, Y1) emit light for a prescribed period of time, the scanning-side electrode Y1 is discharged to 0 V by the selected pull-down thyristor 154 via the pull-down line. The modulation voltage output signal MO becomes "L", and thus the output of the modulation reference voltage VM to the modulation common voltage line 123 is stopped. The ramp wave charging signal MD becomes "H" for a prescribed period of time, and thus the FET 306 is turned ON so as to discharge the charge accumulated in the gate capacitor 304. Accordingly, the p-channel FET 301 is turned ON so as to discharge the charge accumulated in the EL elements (X1*a*, Y1) and (X1*b*, Y1).

Thus, driving of the selected scanning-side electrode Y1 is terminated. Until being driven in the second frame, the scanning-side electrode Y1 is in a floating state in which the scanning-side electrode Y1 is electrically isolated from the write driving power supply circuit 104. The scanning-side electrodes Y2 through Ym are sequentially driven in a similar manner. Thus, driving in the first frame is completed.

In the second frame, an exclusive-OR of the display data signals D0 through D2 and the PN frame signal PNF which are input to the driving control circuit 101 is calculated. As a result, the display data signals D0 through D2 are not inverted, and are output to the data-side driving circuit 103 as the display data signals DA0 through DA2.

The data-side driving circuit 103 receives the display data signals DA0 through DA2, the data transfer clock signal CKD, and the data latch signal DLS. The display data signals DA0 through DA2 are transferred to a prescribed position in the shift register and latch circuits 200 (FIG. 2) in the data-side control circuit 131 by the data transfer clock signal CKD. Then, the display data signals DA0 through DA2 are once latched at the rise of the data latch signal DLS. Thus, display data signals DA0(X) through DA2(X) are generated.

All the scanning-side electrodes Y1, Y2, . . . , Ym connected to the scanning-side driving circuit 105 are kept at the floating potential. The modulation common voltage line 123 receives the modulation reference voltage pulse VMB in accordance with the modulation voltage output signal MO. The data-side electrodes X1*a*, X1*b*, . . . , Xna and Xnb are each supplied with a modulation voltage of a desired level from the data-side driver 132 in accordance with the analog switch control signal MP and the ramp wave RVM. The analog switch control signal MP is obtained by processing the step clock signal SCK, the ramp wave output signal RP and the display data signals DA0(X) through DA2(X) by the data-side driving control circuit 131. The ramp wave RVM is supplied from the ramp wave line 124.

The data-side driver 132, which is connected to the data-side electrodes X1*a* and X1*b* corresponding to the EL elements (X1*a*, Y1) and (X1*b*, Y1) is charged until the gate capacitor 304 is charged to 6/7VM (30 V), the FET 300 is turned ON, and the data-side electrodes X1*a* and X1*b* are charged to 6/7VM (30 V).

Next, the pulse-like write driving voltage supplied from the write power supply circuit 104, i.e., −VW (−180 V) is supplied to the selected scanning-side electrode Y1 via the pull-down line and the selected pull-down thyristor 154 in the scanning-side driver 152. Thus, the scanning-side electrode Y1 is charged to −VW (−180 V).

Therefore, the voltage applied to both of two ends of the EL elements (X1*a*, Y1) and (X1*b*, Y1) is −(VW+6/7VM) (210 V). This value is obtained as a result of the write driving voltage and the modulation voltage being superimposed on each other. In this case, the EL element (X1*a*, Y1) is caused to emit light at luminance level 6, but the EL element (X1*b*, Y1) is caused to emit light only at about luminance level 4.

After the EL elements (X1*a*, Y1) and (X1*b*, Y1) emit light for a prescribed period of time, the scanning-side electrode Y1 is discharged to 0 V by the selected pull-up thyristor 153 via the pull-up line. The modulation voltage output signal MO becomes "L", and thus the output of the modulation reference voltage VM to the modulation common voltage line 123 is stopped. The ramp wave charging signal MD becomes "H" for a prescribed period of time, and thus the FET 306 is turned ON so as to discharge the charge accumulated in the gate capacitor 304. Accordingly, the p-channel FET 301 is turned ON so as to discharge the charge accumulated in the EL elements (X1*a*, Y1) and (X1*b*, Y1).

Thus, driving of the selected scanning-side electrode Y1 is terminated. Until being driven in the first frame, the scanning-side electrode Y1 is in a floating state in which the scanning-side electrode Y1 is electrically isolated from the write driving power supply circuit 104. The scanning-side electrodes Y2 through Ym are sequentially driven in a similar manner. Thus, driving in the second frame is completed.

The conventional inorganic EL display device 1000 has the following problems.

In the conventional inorganic EL display device 1000 described above, the modulation voltage which is output from the data-side driving circuit 103 is output with a prescribed amplitude based on the display data signal. The relationship between the display data signal and the amplitude of the modulation voltage is the same in the light emitting layer of both of two display dots included in one pixel.

As shown in FIG. 7, in an inorganic EL element including a plurality of types of light emitting layers having different voltage vs. luminance characteristics, VW is set to the light emitting threshold voltage VWa (180 V) of the light emitting layer A, and VM is set to 35 V. Gray-scale display is performed by a voltage amplitude obtained by equally dividing the VM into seven. Accordingly, even a voltage which is optimum for the light emitting layer A only causes the light emitting layer B to emit light in the range of a non-emission level to a low luminance level. Thus, sufficient gray-scale display cannot be provided. In the case where the VW is set so as to provide optimum gray-scale display including a complete erasure state to a complete emission state to one of the light emitting layers, optimum gray-scale display cannot be provided to the other light emitting layer.

In the case where the VM is set to the difference (45 V) between the light emitting threshold voltage VWa (180 V) of the light emitting layer A and the light emitting saturation voltage VSb (225 V) of the light emitting layer B, a voltage amplitude obtained by simply equally dividing the voltage into seven is applied, the width between grades of a high luminance range is narrow with the light emitting layer A and the width between grades of a low luminance range is narrow with the light emitting layer B. Neither light emitting layer provides optimum gray-scale display.

In order to optimize the light emission state in an inorganic EL element display device including a plurality of types of light emitting layers having different voltage vs. luminance characteristics, Japanese Laid-Open Publication No. 10-39835 discloses a method for optimizing the pulse application time (pulse width) for each light emitting layer. However, an inorganic EL element is a capacitive element as can be appreciated from the structure thereof, and therefore is not suitable to a pulse width gray-scale method.

When a rectangular driving pulse is applied to an inorganic EL element, the current contributing to light emission steeply rises to a peak immediately after a rise of the voltage and behaves similarly to the current charging a capacitor. The current flows in a very short time of several microseconds. Therefore, even when the pulse width after the current flows is controlled, a sufficient luminance difference cannot be provided between grades. Accordingly, in order to provide gray-scale display having a sufficient luminance difference by controlling the pulse width, it is necessary to set a multi-stage pulse within several microseconds in which the charging current flows. However, even a slight change in the pulse width, caused by, for example, the response speed of the driving circuit or the control precision of the pulse width, significantly changes the luminance.

Optimum gray-scale display can be provided for all the light emitting layers by producing a plurality of types of light emitting layers having exactly the same voltage vs. luminance characteristic. It is very difficult to produce such inorganic EL elements with high reproducibility.

SUMMARY OF THE INVENTION

A display device according to the present invention includes a display panel including a plurality of first electrodes, a plurality of second electrodes crossing the plurality of first electrodes, and a plurality of light emitting layers having different light emission characteristics provided at intersections of the plurality of first electrodes and the plurality of second electrodes; a data-side driving circuit connected to the plurality of first electrodes for supplying a modulation voltage to the plurality of first electrodes; a modulation driving power supply circuit for supplying a modulation power supply voltage to the data-side driving circuit; a scanning-side driving circuit connected to the plurality of second electrodes for sequentially supplying a write voltage to the plurality of second electrodes; a write driving power supply circuit for supplying a write voltage to the scanning-side driving circuit; and a driving control circuit for controlling the data-side driving circuit, the modulation driving power supply circuit, the scanning-side driving circuit, and the write driving power supply circuit. Gray-scale display is realized by changing an amplitude of the modulation voltage which is output from the data-side driving circuit. The driving control circuit is capable of supplying a first display data signal representing (m+n) grades, obtained by adding m grades represented by a second display data signal externally input and an adjustable range n, so that the modulation voltage having an amplitude corresponding to the light emission characteristic of each of the plurality of light emitting layers is supplied to the corresponding light emitting layer, where m is an integer of two or greater and n is an integer of one or greater. The data-side driving circuit is capable of outputting modulation voltages having (m+n) types of amplitudes to the plurality of first electrodes in accordance with the first display data signal The amplitude of the modulation voltage corresponding to the light emission characteristic of a prescribed light emitting layer among the plurality of light emitting layers is adjusted to an amplitude in the adjustable range n from the amplitude corresponding to the grade represented by the second display data signal.

In one embodiment of the invention, the adjustable range n is determined based on a signal input to the driving control circuit.

In one embodiment of the invention, the adjustable range n is determined based on built-in data in the driving control circuit.

A modulation voltage output section of the data-side driving circuit may be formed of a source follower-type element.

Hereinafter, the function of the present invention will be described.

According to the present invention, for performing gray-scale display in a display device including a plurality of types of light emitting layers having different voltage vs. luminance characteristics, the modulation voltage VM which is output from the data-side driving circuit is adjusted to have an optimum amplitude in accordance with the display data signal and the light emission characteristic of each of the light emitting layers. Thus, optimum gray-scale display can be provided by each light emitting layer.

The adjustable range n of the modulation voltage can be defined based on a signal which is input to the driving control circuit. In the case where the driving control circuit includes built-in modulation voltage adjusting signals, the adjustable range n can automatically be defined in correspondence with the pre-defined light emitting layer.

Thus, the invention described herein makes possible the advantages of providing a display device including a plurality of types of light emitting layers having different voltage vs. luminance characteristics, which provides optimum gray-scale display for each light emitting layer.

These and other advantages of the present invention will become apparent to those skilled in the art upon reading and understanding the following detailed description with reference to the accompanying figures.

BRIEF DESCRIPTION OF THE DRAWINGS

FIG. 1 is a circuit diagram of a conventional inorganic EL display device;

DESCRIPTION OF THE PREFERRED EMBODIMENTS

Hereinafter, the present invention will be described by way of illustrative examples with reference to the accompanying drawings.

Figure 2:
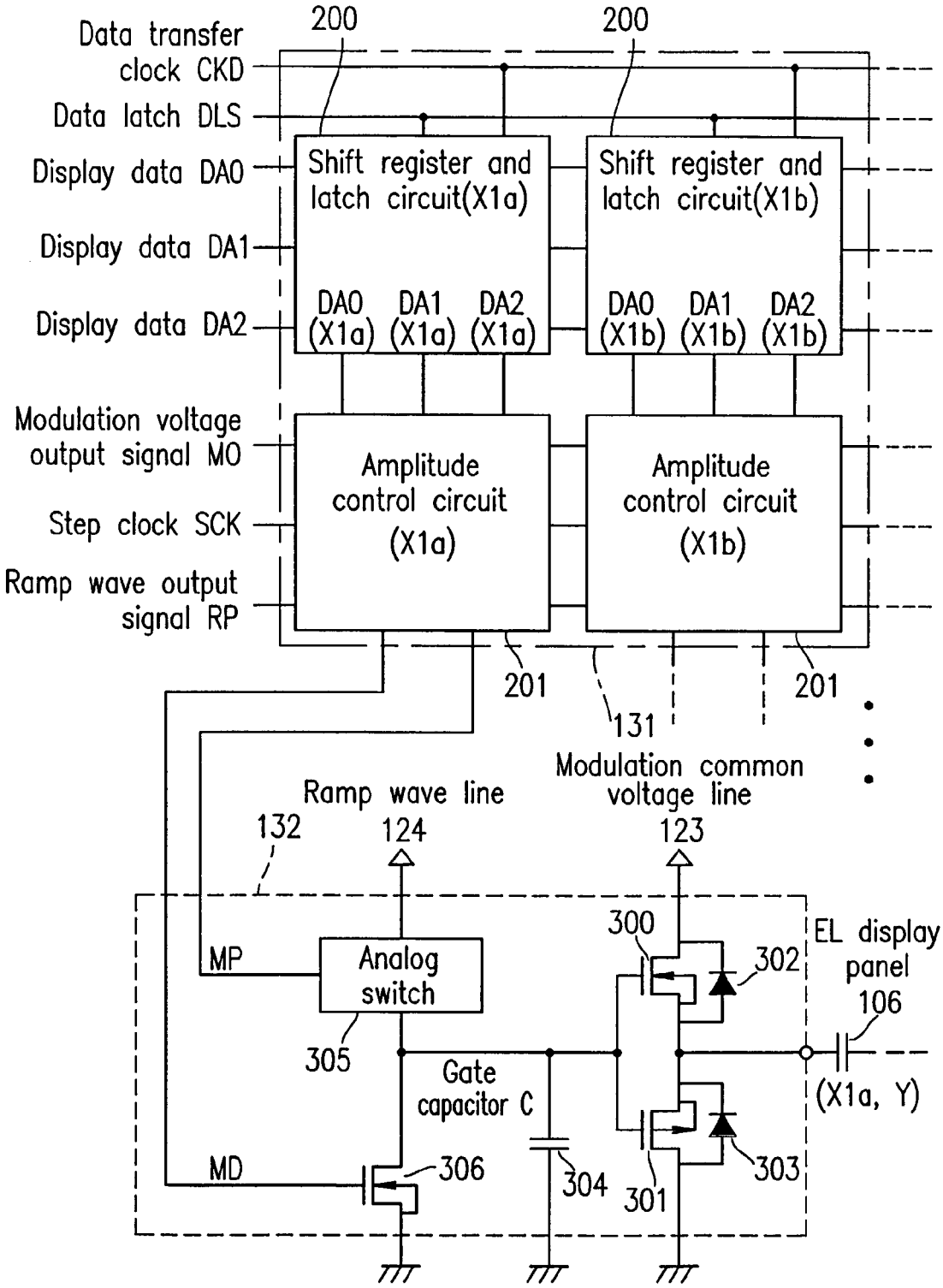
FIG. 2 is a circuit diagram of a data-side driving circuit of the conventional inorganic EL display device.
Figure 3:
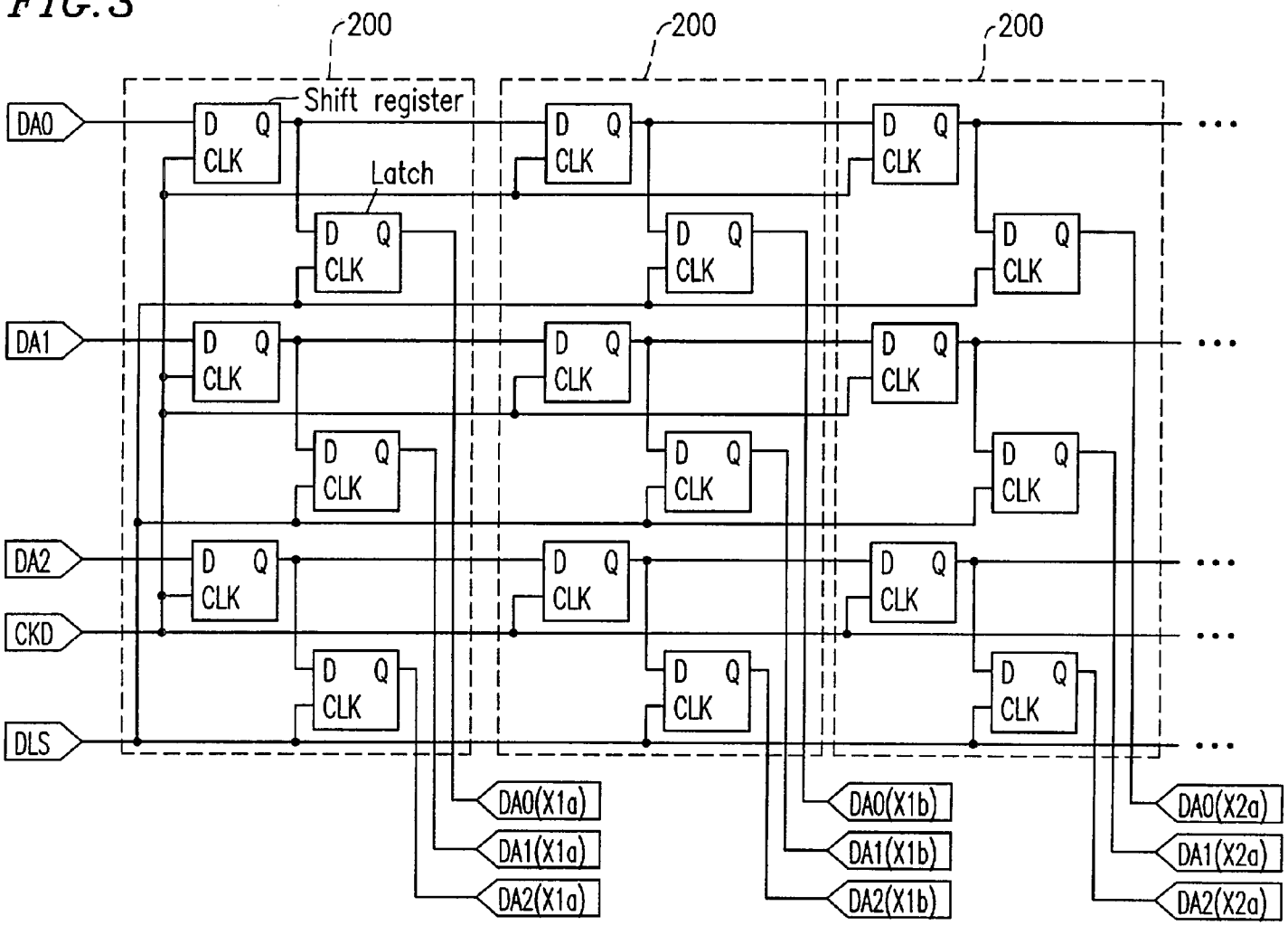
FIG. 3 is a circuit diagram of shift register and latch circuits of the conventional inorganic EL display device.
Figure 4:
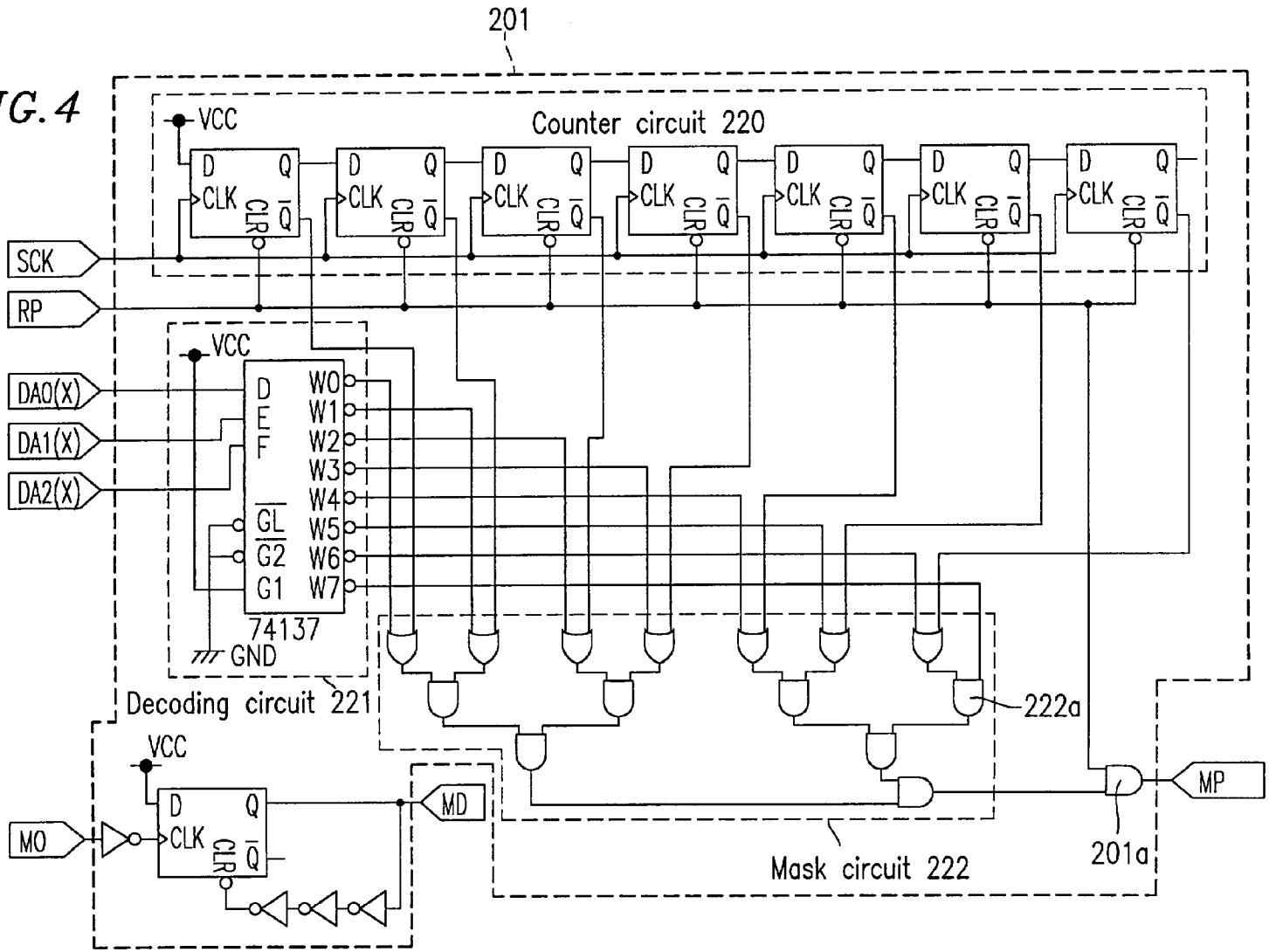
FIG. 4 is a circuit diagram of an amplitude control circuit of the conventional inorganic EL display device.
Figure 5:
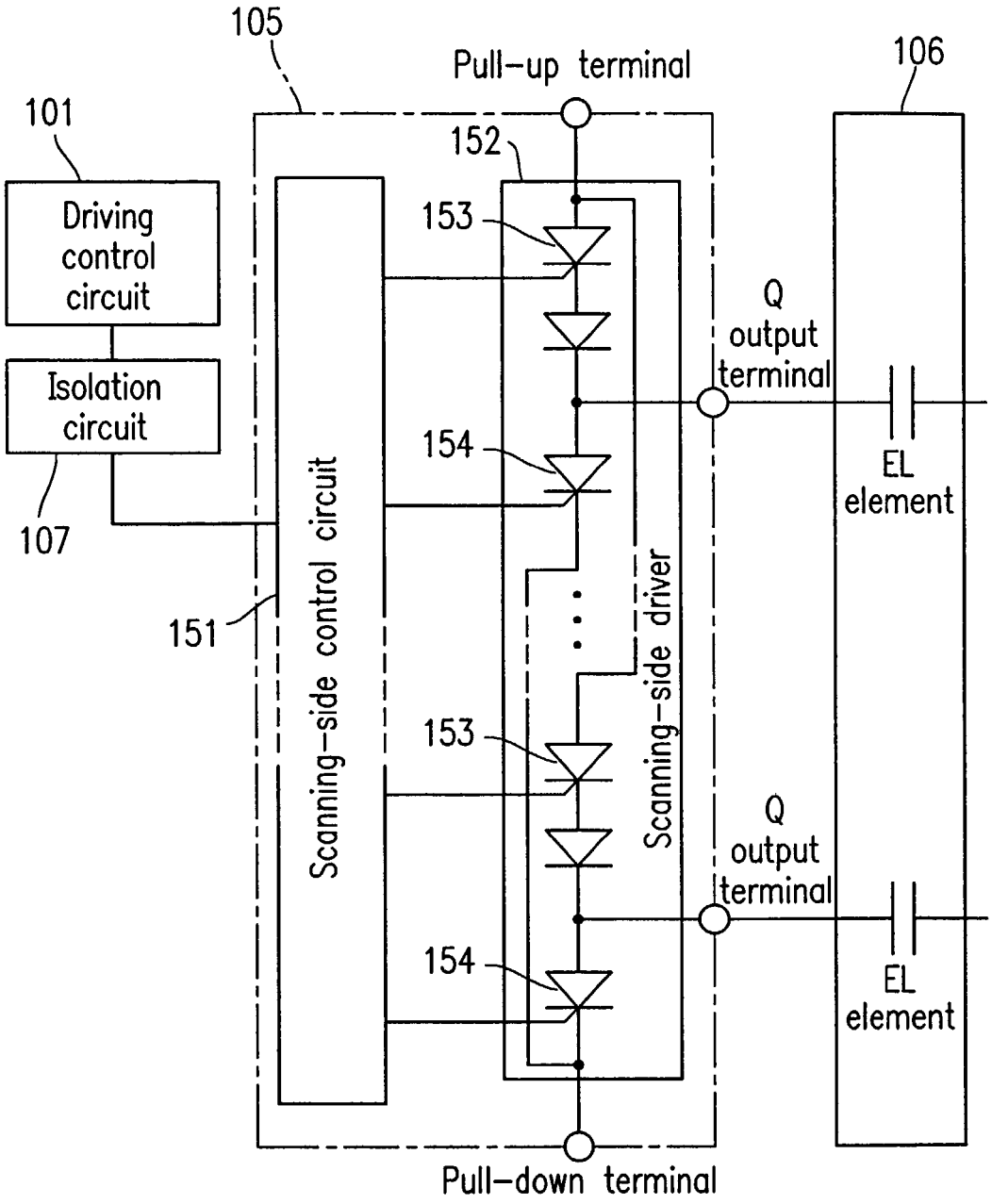
FIG. 5 is a circuit diagram of a scanning-side driving circuit of the conventional inorganic EL display device.
Figure 6A:
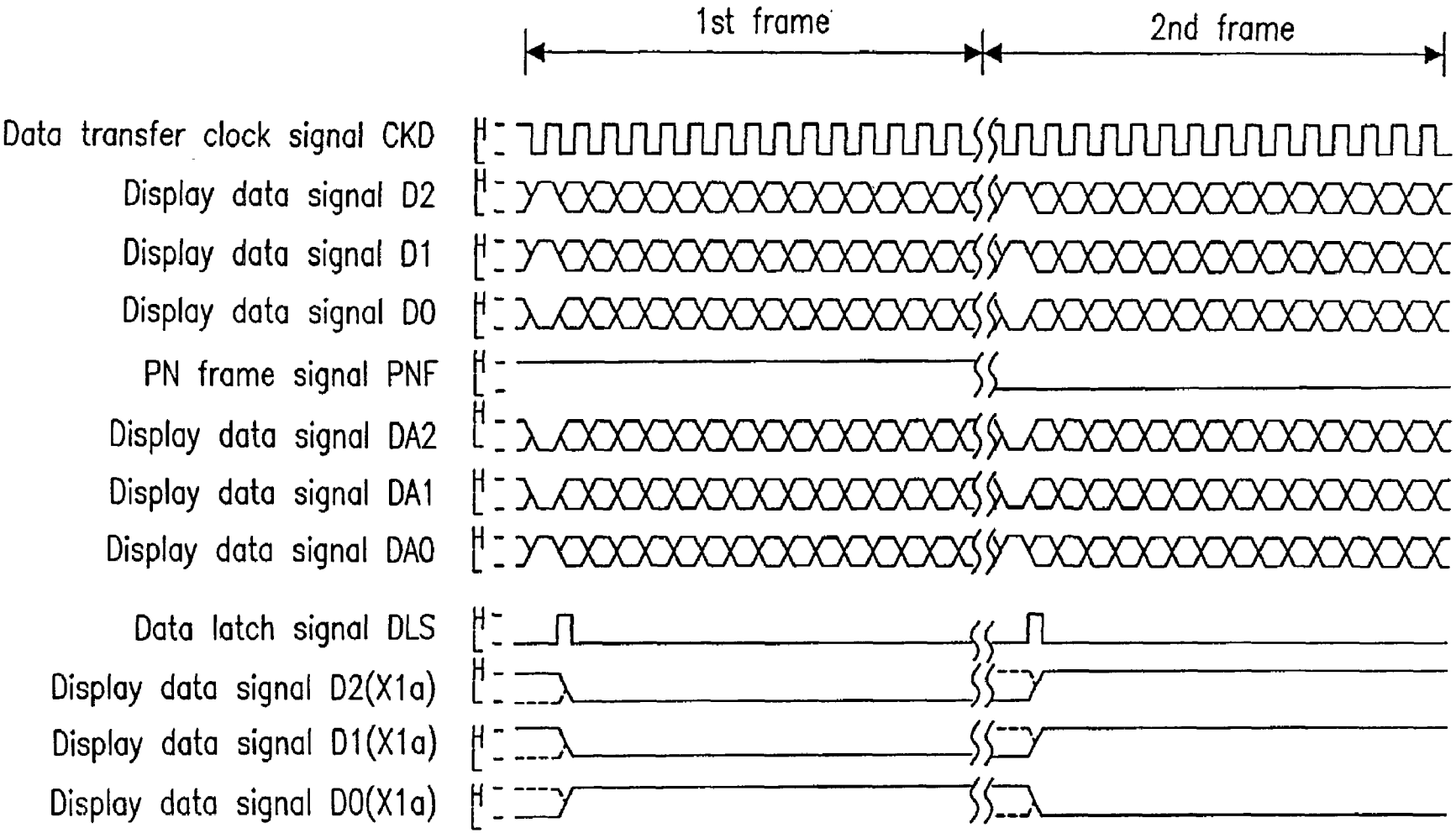
FIG. 6A is a timing diagram illustrating an operation state of the conventional inorganic EL display device.
Figure 6B:
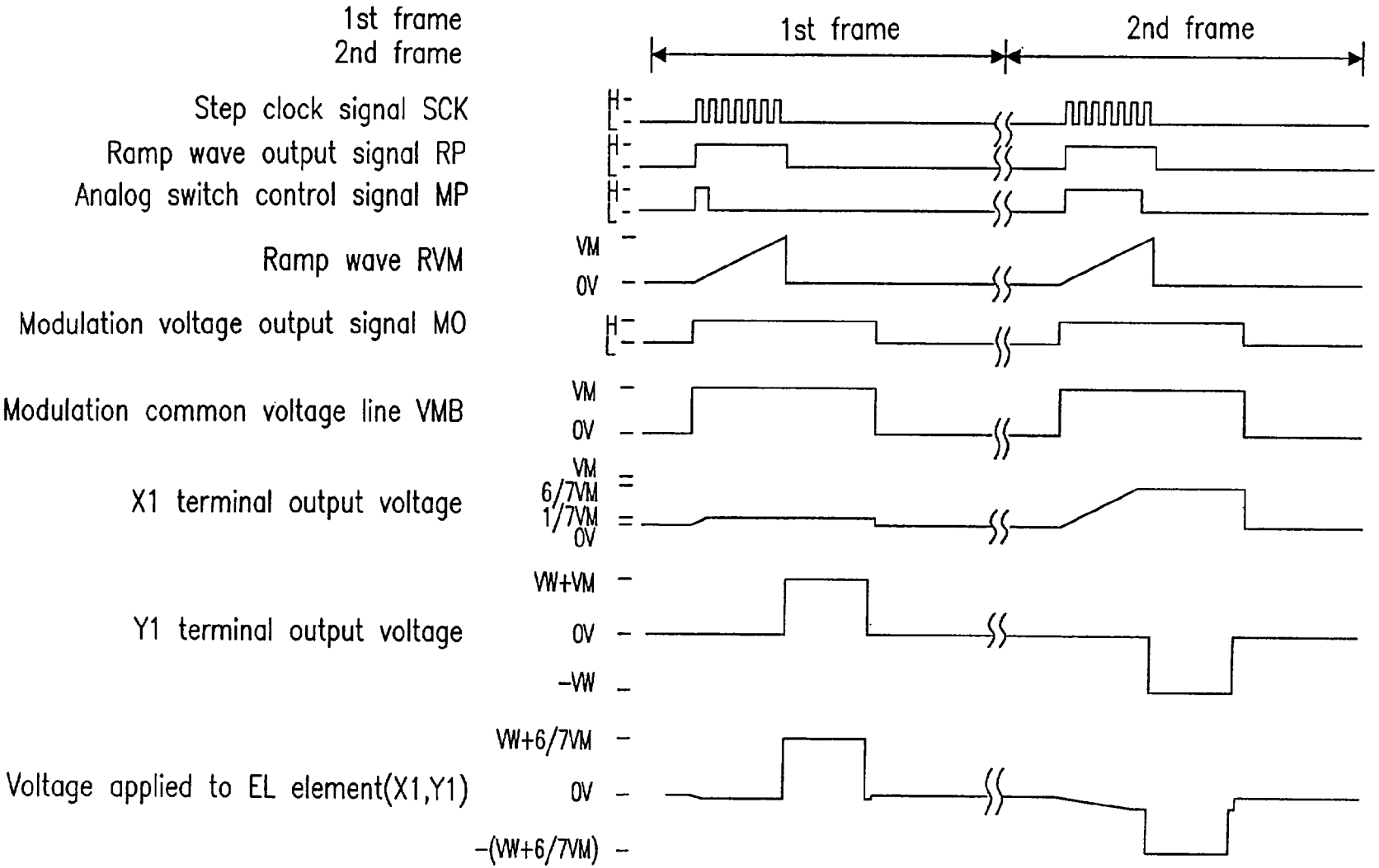
FIG. 6B is a timing diagram illustrating an operation state of the conventional inorganic EL display device.
Figure 7:
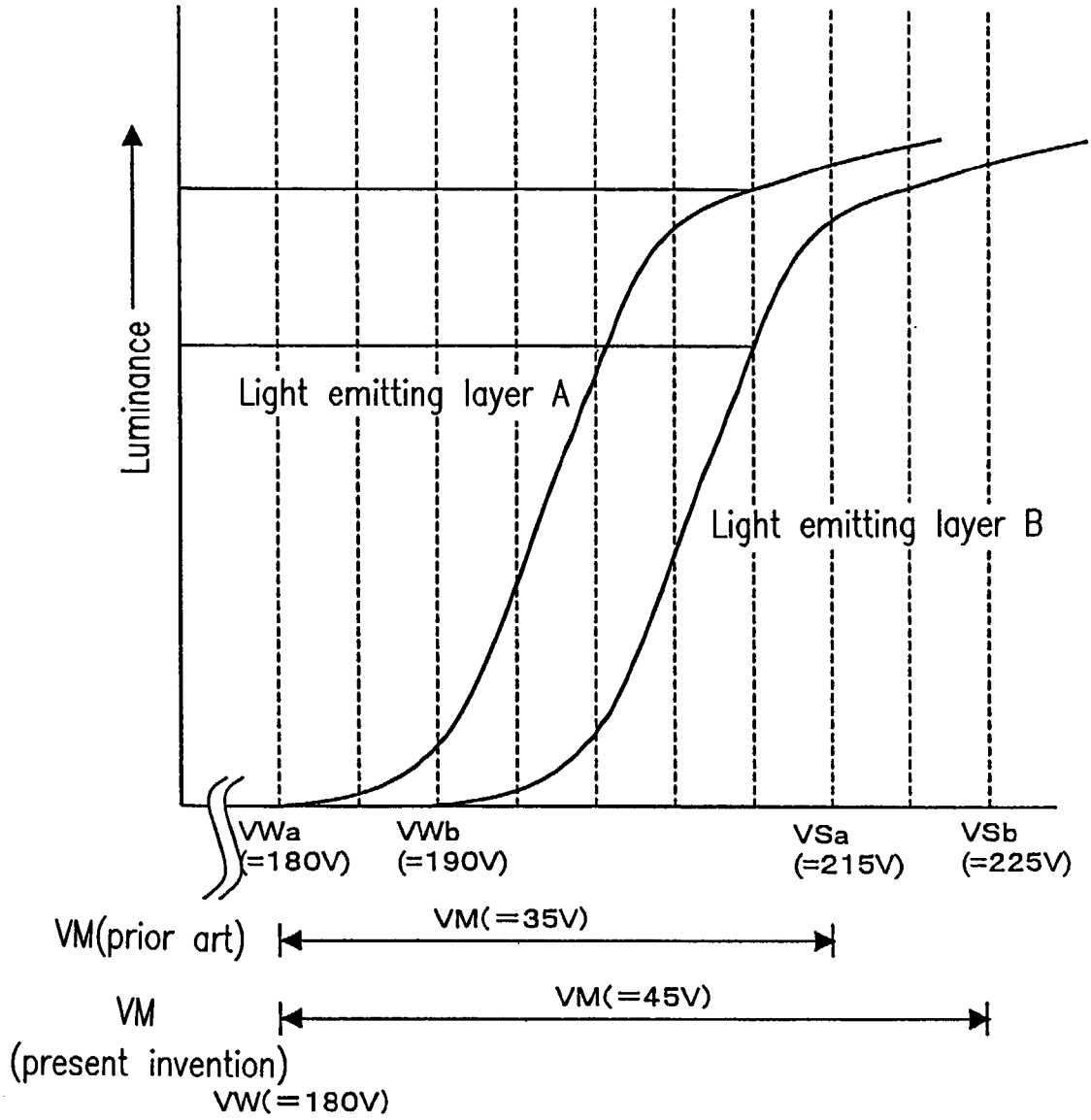
FIG. 7 is a graph illustrating the voltage vs. luminance characteristics of an inorganic EL element.
Figure 8:
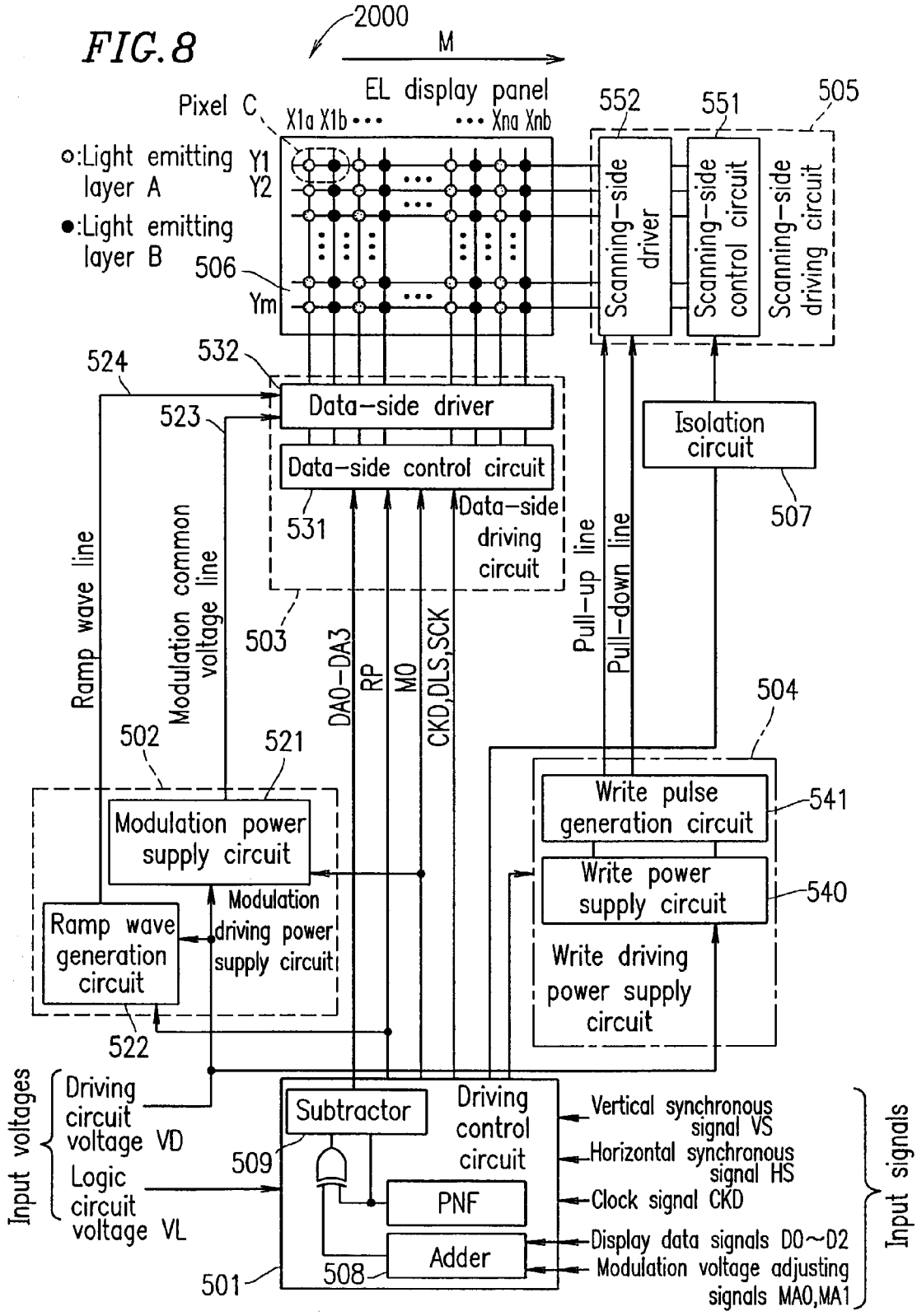
FIG. 8 is a circuit diagram of an inorganic EL display device according to an example of the present invention.

FIG. 8 shows an inorganic EL display device 2000 according to an example of the present invention. In this example, an adjusting voltage width corresponding to two grades is set for performing eight-grade display using two types of light emitting layers having different voltage vs. luminance characteristics as shown in FIG. 7.

The inorganic EL display device 2000 shown in FIG. 8 includes an EL display panel 506. The EL display panel 506 includes data-side electrodes X1*a*, X1*b*, . . . , Xna and Xnb, and scanning-side electrodes Y1, Y2, . . . , Ym. The data-side electrodes and the scanning-side electrodes cross each other, for example, perpendicularly. At each of intersections of the data-side electrodes and the scanning-side electrodes, a light emitting layer A or a light emitting layer B is provided in the state of being interposed between two insulating layers. The light emitting layer A has the voltage vs. luminance characteristic shown in FIG. 7 (labeled as "light emitting layer A"), and has a light emitting threshold voltage of VWa and a light emitting saturation voltage of VSa. The light emitting layer B has the voltage vs. luminance characteristic shown in FIG. 7 (labeled as "light emitting layer B"), and has a light emitting threshold voltage of VWb and a light emitting saturation voltage of VSb. The light emitting layer A or the light emitting layer B and two insulating layers interposing the respective light emitting layer act as a display dot. As shown in FIG. 8, a display dot including the light emitting layer A and a display dot including the light emitting layer B are arranged alternately in an M direction. A pixel includes a pair of display dots of these two types.

A driving control circuit 501 is provided in the vicinity of the EL display panel 506. The driving control circuit 501 receives external signals including a vertical synchronous signal VS, a horizontal synchronous signal HS, a data transfer clock signal CKD, display data signals D0 through D2, and modulation voltage adjusting signals MA0 and MA1. The display data signals D0 through D2 exhibit m-grades of luminance (m is an integer of two or greater). In this example, display data signals D0 through D2 exhibit eight-grade luminance. Table 3 shows the relationship between the display data signals D0 through D2 and the luminance. In Table 3, L0 represents the lowest luminance and L7 represents the highest luminance.

TABLE 3

| | Luminance | D2 | D1 | D0 |
|---|---|---|---|---|
| Brightest | L7 | H | H | H |
| . | L6 | H | H | L |
| . | L5 | H | L | H |
| . | L4 | H | L | L |
| . | L3 | L | H | H |
| . | L2 | L | H | L |
| . | L1 | L | L | H |
| Darkest | L0 | L | L | L |

The driving control circuit 501 is operated by a logic circuit voltage VL (e.g., 5 V) which is externally input to the driving control circuit 501.

The driving control circuit 501 generates the following control signals in order to control an operating timing of each of a plurality of portions of the EL display device 2000 in accordance with the input signal. A PN frame signal PNF controls a first frame and a second frame of a display frame. The PN frame signal PNF is "H" in the first frame and is "L" in the second frame. A ramp wave output signal RP controls a ramp wave. A ramp wave is output when the ramp wave output signal RP is "H". A step clock signal SCK equally divides the time period in which the ramp wave output signal RP is "H" into nine. A modulation voltage output signal MO controls a modulation reference voltage pulse. A modulation reference voltage pulse is applied to a modulation common voltage line 523 while the modulation voltage output signal MO is "H". "CKD" refers to a data transfer clock signal as described above, and "DLS" refers to a data latch signal.

The modulation voltage adjusting signals MA0 and MA1 are signals for defining a shift amount (adjusting range n of the grades (n is an integer of one or greater). In this example, n=2. The modulation voltage adjusting signals MA0 and MA1 are input to the driving control circuit 501 in synchronization with the data transfer clock signal CKD. In this example, the shift amount is defined as shown in Table 4. Since three types of adjustment of "no shift", "shift by one grade" and "shift by two grades" are controlled with 2 bits in this example, "no shift" is assigned to LL and LH.

TABLE 4

| MA0 | MA1 | Shift amount of grades |
|---|---|---|
| L | L | No shift |
| L | H | No shift |
| H | L | Shift by one grade to the higher side |
| H | H | Shift by two grade to the higher side |

The input display data signals D0 through D2 and the modulation voltage adjusting signals MA0 and MA1 are added together by an adder 508 included in the driving control circuit 501. The addition result is output to display data signals DA0 through DA3. Accordingly, the grades of luminance level 6 is adjusted in the range shown in Table 5.

TABLE 5

| | — | D2 | D1 | D0 |
|---|---|---|---|---|
| L6 | — | H | H | L |
| | DA3 | DA2 | DA1 | DA0 |
| MA0, MA1 (L, L) | L | H | H | L |
| MA0, MA1 (L, H) | L | H | H | L |
| MA0, MA1 (H, L) | L | H | H | H |
| MA0, MA1 (H, H) | H | L | L | L |

In the inorganic EL display device 2000, highly symmetrical AC pulses are applied to the light emitting layers in order to provide highly reliable display. In the first frame, a positive write voltage +(VW+VM) is applied; and in the second frame, a negative write voltage −VW is applied. As such, in the first frame, the amplitude of the modulation voltage needs to be lower as the luminance level is higher, and higher as the luminance level is lower. In the second frame, by contrast, the amplitude of the modulation voltage needs to be higher as the luminance level is higher, and lower as the luminance level is lower.

In this example, an exclusive-OR of the sum of the display data signals D0 through D2 and the modulation voltage adjusting signals MA0 and MA1, and the PNF signal is calculated. The resultant value corresponds to the value obtained by inverting the sum of the display data signals D0 through D2 and the modulation voltage adjusting signals MA0 and MA1. From this resultant value, 6 is subtracted by a subtractor 509. The resultant display data signals DA0 through DA3 are supplied to the data-side driving circuit 503. In the second frame, an exclusive-OR of the sum of the display data signals D0 through D2 and the modulation voltage adjusting signals MA0 and MA1, and the PNF signal is calculated. The resultant value corresponds to the sum of the display data signals D0 through D2 and the modulation voltage adjusting signals MA0 and MA1. This resultant value is applied to the data-side driving circuit 503 with no alteration. The display data signals DA0 through DA3 supplied to the data-side driving circuit 503 are as shown in Table 6.

TABLE 6

| Luminance | 1st frame | | | | 2nd frame | | | |
|---|---|---|---|---|---|---|---|---|
| level | DA3 | DA2 | DA1 | DA0 | DA3 | DA2 | DA1 | DA0 |
| Bright | L | L | L | L | H | L | L | H |
| . | L | L | L | H | H | L | L | L |
| . | L | L | H | L | L | H | H | H |
| . | L | L | H | H | L | H | H | L |
| . | L | H | L | L | L | H | L | H |
| . | L | H | L | H | L | H | L | L |
| . | L | H | H | L | L | L | H | H |
| . | L | H | H | H | L | L | H | L |
| . | H | L | L | L | L | L | L | H |
| Dark | H | L | L | H | L | L | L | L |

The modulation voltage output signal MO generated by the driving control circuit 501 is supplied to a modulation power supply circuit 521 included in a modulation driving power supply circuit 502. The modulation power supply circuit 521 uses a DC/DC converter or the like to boost a driving circuit voltage VD (e.g., 12 V), which is externally input thereto, to a DC voltage having an amplitude VM. Then, the modulation power supply circuit 521 converts the DC voltage to a modulation reference voltage pulse VMB in synchronization with the modulation voltage output signal MO. In this example, the VM is set to the difference (45 V)

between the light emitting threshold voltage VWa (180 V) of the light emitting layer A and the light emitting saturation voltage VSb (225 V) of the light emitting layer B. The modulation reference voltage pulse VMB obtained by the modulation power supply circuit 521 is output to the modulation common voltage line 523 as a modulation power supply voltage.

The ramp wave output signal RP generated by the driving control circuit 501 is supplied to a ramp wave generation circuit 522 included in the modulation driving power supply circuit 502. In synchronization with a rise of the ramp wave output signal RP, the ramp wave generation circuit 522 starts generating a ramp wave RVM having a peak amplitude VM from the driving circuit voltage VD.

A generated ramp wave RVM is inclined such that the amplitude reaches the peak amplitude VM when the ramp wave output signal RP starts to fall. The ramp wave RVM is returned to a ground GND in synchronization with the fall of the ramp wave output signal RP. The ramp wave RVM generated by the ramp wave generation circuit 522 is output to a ramp wave line 524.

Figure 9:
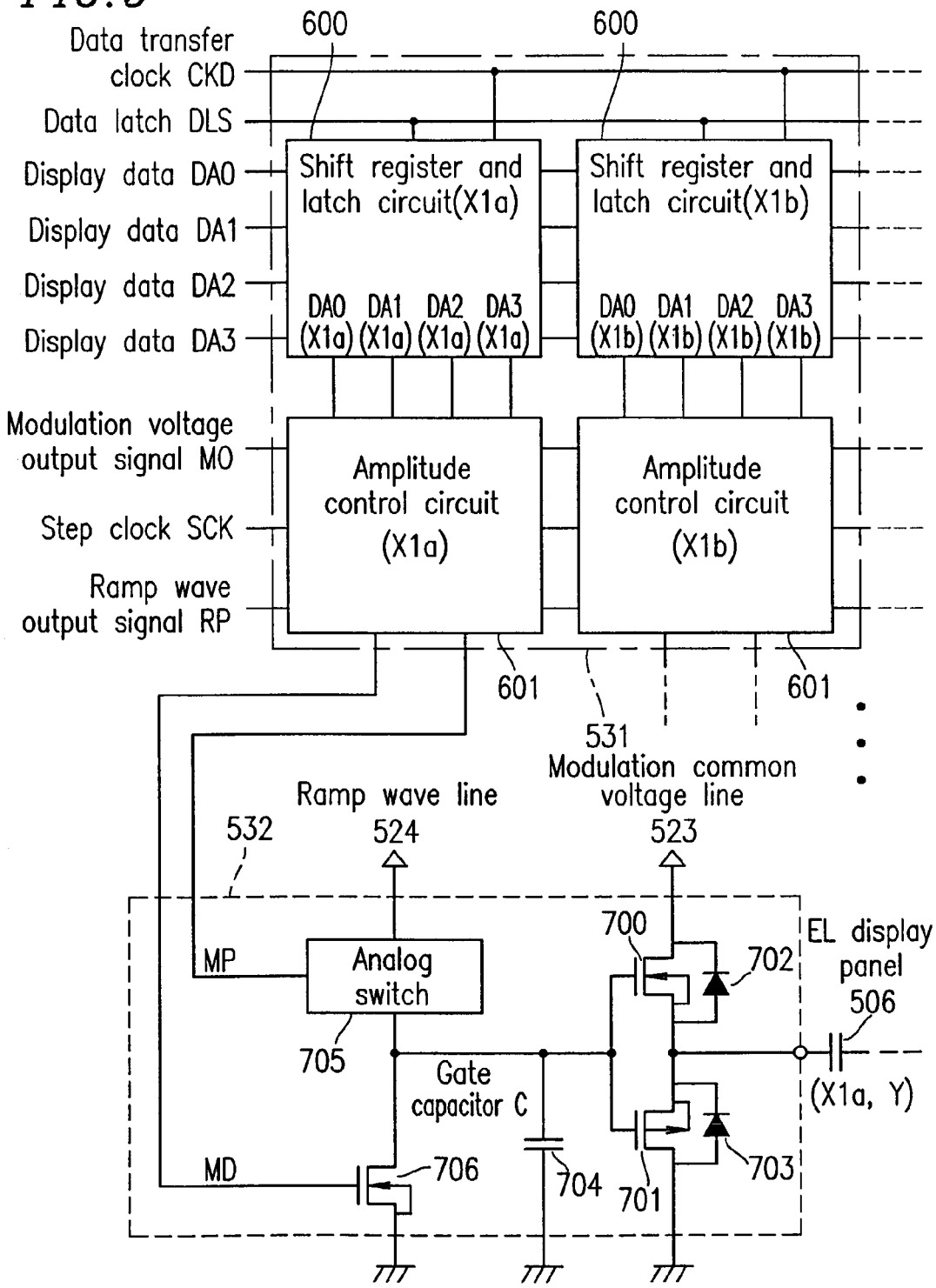
FIG. 9 is a circuit diagram of a data-side driving circuit of the inorganic EL display device according to the example of the present invention.

The display data signals DA0 through DA3, the ramp wave output signal RP, the modulation voltage output signal MO, the data transfer clock signal CKD, the data latch signal DLS, and the step clock signal SCK are supplied to a data-side control circuit 531 included in the data-side driving circuit 503. As shown in FIG. 9, the data-side control circuit 531 includes shift register and latch circuits 600 and amplitude control circuits 601. One shift register and latch circuit 600 and one amplitude control circuit 601 are provided for each of the data-side electrodes X1*a*, X1*b*, . . . Xna and Xnb.

Figure 10:
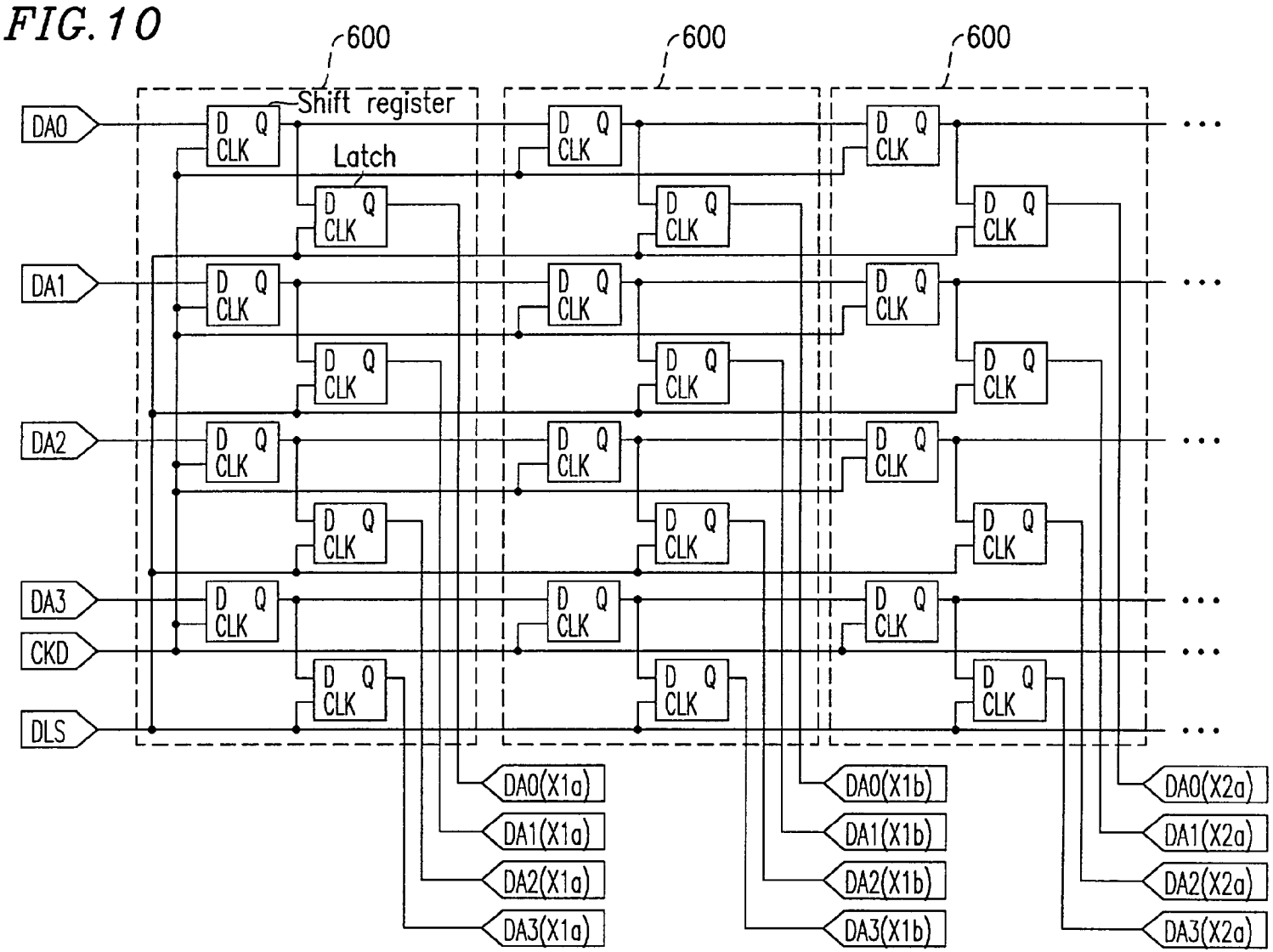
FIG. 10 is a circuit diagram of shift register and latch circuits of the inorganic EL display device according to the example of the present invention.

The shift register latch circuit 600 receives the data transfer clock signal CKD, the data latch signal DLS, and the display data signals DA0 through DA3. As shown in FIG. 10, each shift register and latch circuit 600 includes four shift registers and four latches. Each shift register receives one of display data signals DA0 through DA3 at a D input terminal and receives a data transfer clock signal CKD at a CLK input terminal. The shift registers and the latches are connected to each other one by one. More specifically, a Q output terminal of a shift register is connected to a D input terminal of the latch. Each latch receives a data latch signal DLS at a CLK input terminal and is connected to the amplitude control circuits 601 (FIG. 9) at a Q output terminal. The Q output terminal of each shift register is also connected to a D input terminal of a shift register in the shift register and latch circuit 600 corresponding to the next data-side electrode.

In the shift register and latch circuits 600, the display data signals DA0 through DA3 (4 bits) are transferred to the respective shift registers in parallel in synchronization with the data transfer clock CKD. After each horizontal period, data is latched in the latch by the data latch signal DLS. Thus, display data signals DA0(X) through DA3(X) are obtained. Here, (X) refers to one of X1*a*, X1*b*, X2*a*, . . . , Xna and Xnb.

Figure 11:
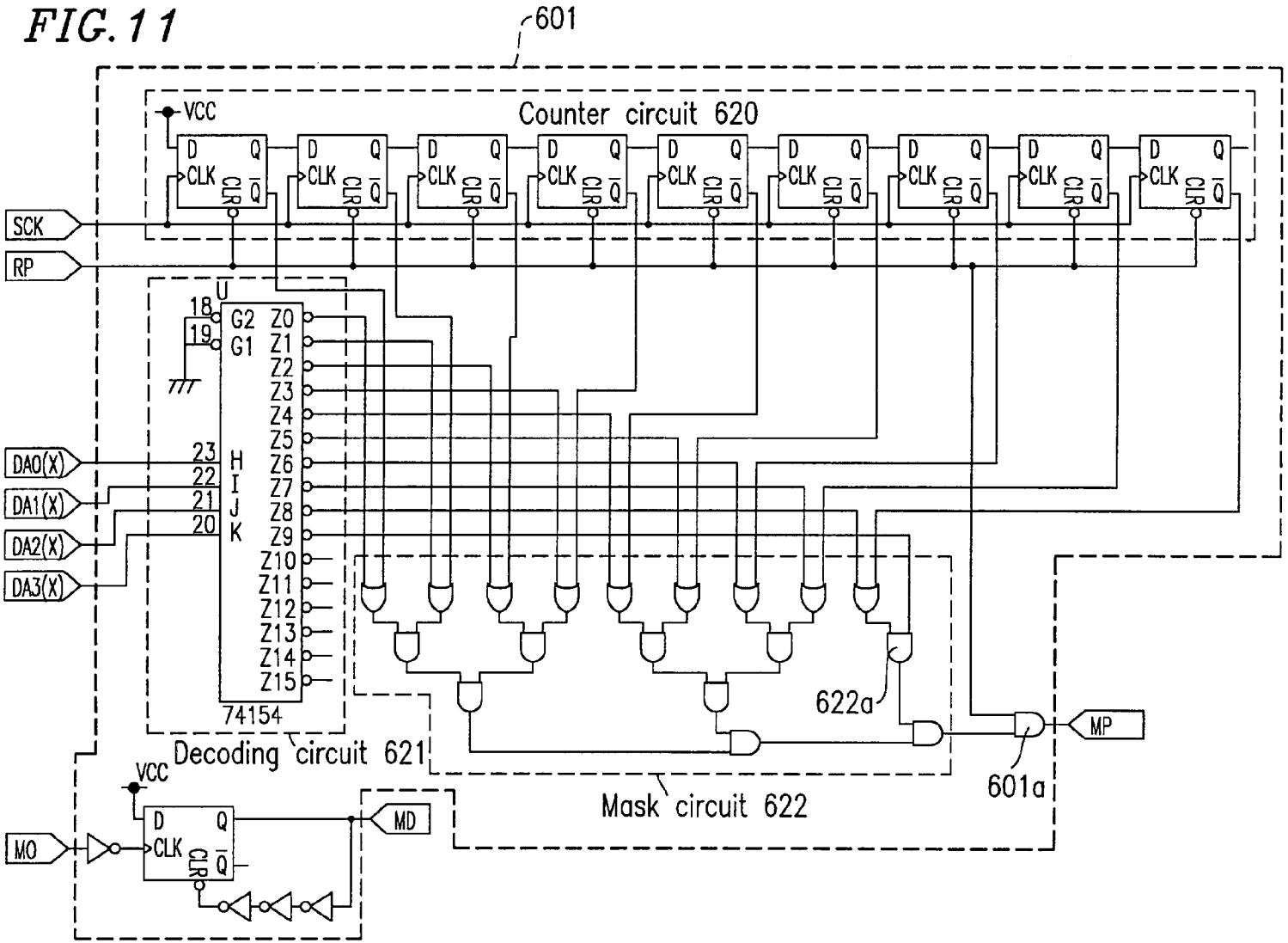
FIG. 11 is a circuit diagram of an amplitude control circuit of the inorganic EL display device according to the example of the present invention.

The amplitude control circuit 601 receives the ramp wave output signal RP, the modulation voltage output signal MO and the step clock signal SCK which are generated by the driving control circuit 501, and the display data signals DA0(X) through DA3(X) from the shift register and latch circuits 600. As shown in FIG. 11, the amplitude control circuit 601 includes a counter circuit 620, a decoding circuit 621 and a mask circuit 622.

The counter circuit 620 includes nine flip-flop circuits. Each flip-flop circuit receives a step clock signal SCK at a CLK input terminal and receives a ramp wave output signal RP at a CLR terminal. A Q output terminal of one flip-flop circuit is connected to a D input terminal of the next flip-flop circuit. A /Q output terminal is connected to an input of a corresponding OR circuit. The OR circuits are included in the mask circuit 622. A D input terminal in the leftmost flip-flop circuit is connected to a supply voltage VCC. The counter circuit 620 receives the step clock signal SCK and the ramp wave output signal RP, and outputs signals having nine different pulse widths. The pulses rise at the /Q terminals of the flip-flop circuits at the same timing, and fall at different timings in synchronization with the rise of the step clock signal SCK. The pulse in one flip-flop circuit falls at a later time than the pulse in the flip-flop circuit to the left thereof.

The decoding circuit 621 includes a 4-bit-to-16-line decoder (corresponding to the standard logic 74154). The decoding circuit 621 receives the display data signals DA0(X) through DA3(X) from the shift register and latch circuit 600 respectively at select input terminals H, I, J and K, and thus outputs mask signals corresponding to the grades respectively from output terminals Z0 through Z9. Output terminals Z10 through Z15 are empty terminals. Each mask signal is used for outputting only a signal having a necessary pulse width, among the signals having the nine different width output from the counter circuit 620, as an RP signal, and masking the other eight signals. The mask signals from the output terminals Z0 through Z8 are respectively output to one of two input terminals of the nine OR circuits included in the mask circuit 622. The mask signal from the output terminal Z9 is output to one input terminal of an AND circuit 622*a* which is not connected to any output terminal of any OR circuit in the mask circuit 622.

The mask circuit 622 includes AND circuits and OR circuits. Among the signals having nine different pulse widths which are output from the counter circuit 620, a signal having a pulse width corresponding to one of the display data signals DA0(X) through DA3(X) is selected. An output from the mask circuit 622 is output to an AND circuit 601*a* connected to the mask circuit 622. The AND circuit 601*a* also receives the ramp wave output signal RP. Thus, an analog switch control signal MP for controlling a data-side driver 532 included in the data-side driving circuit 503 is generated.

As shown in FIG. 11, the amplitude control circuit 601 includes another flip-flop circuit. A D input terminal of the flip-flop circuit is connected to the supply voltage VCC. The flip-flop circuit receives a signal obtained by inverting the modulation voltage output signal MO by an inverter at a CLK input terminal. A Q output terminal of the flip-flop circuit is connected to a CLR terminal thereof via three inverters connected in series. Thus, an output from the Q output terminal is received by the CLR terminal in an inverted state. The flip-flop circuit having such a structure generates a ramp wave discharging signal MD from the modulation voltage output signal MO.

The analog switch control signal MP and the ramp wave discharging signal MD which are generated by the amplitude control circuit 601 are supplied to the data-side driver 532. The modulation reference voltage pulse VMB and the ramp wave, which are generated by the modulation driving power supply circuit 502, are also supplied to the data-side driver 532.

As shown in FIG. 9, the data-side driver 532 includes an n-channel FET 700 and a p-channel FET 701 which are connected to each other via sources thereof. The FETs 700 and 701 are respectively connected in parallel to parasitic diodes 702 and 703, thus forming a source follower-type output element. The sources of the FETs 700 and 702 are connected to the data-side electrode X1*a* of the EL display panel 506. A drain of the n-channel FET 700 is connected to the modulation common voltage line 523, which is connected to the modulation driving power supply circuit 502 (FIG. 8). A drain of the p-channel FET 701 is connected to the ground GND. Gates of the FETs 700 and 701 are each connected to a gate capacitor 704 and are also connected to the ramp wave line 524 which is connected to the modulation driving power supply circuit 502 via an analog switch 705.

A gate of the analog switch 705 is controlled by the analog switch control signal MP which is output from the amplitude control circuit 601. When the analog switch 705 is made conductive by the analog switch control signal MP, the potential of the ramp wave is accumulated in the gate capacitor 704. The potential in the gate capacitor 704 is accumulated in the data-side electrode X1*a* as a modulation potential with no alternation. The analog switch control signal MP becomes "H" in a period corresponding to the driving frame and the grade, and the pulse width of the analog switch control signal MP is synchronized with the ramp wave and thus converted into a modulation voltage amplitude.

Table 7-1 and 7-2 show the relationship between the display data signals D0 through D2 externally input to the inorganic EL display device 2000 and the amplitude level of the output modulation driving voltage in the first and second frames.

TABLE 7-1

First frame (write voltage: positive)

| D2 | D1 | D0 | Modulation driving voltage |
|---|---|---|---|
| H | H | H | 0 V |
| H | H | L | 5 V (1/9 VM) |
| H | L | H | 10 V (2/9 VM) |
| H | L | L | 15 V (3/9 VM) |
| L | H | H | 20 V (4/9 VM) |
| L | H | L | 25 V (5/9 VM) |
| L | L | H | 30 V (6/9 VM) |
| L | L | L | 35 V (7/9 VM) |
| — | — | — | 40 V (8/9 VM) |
| — | — | — | 45 V (VM) |

TABLE 7-2

Second frame (write voltage: negative)

| D2 | D1 | D0 | Modulation driving voltage |
|---|---|---|---|
| — | — | — | 45 V (VM) |
| — | — | — | 40 V (8/9VM) |
| H | H | H | 35 V (7/9 VM) |
| H | H | L | 30 V (6/9 VM) |
| H | L | H | 25 V (5/9 VM) |
| H | L | L | 20 V (4/9 VM) |
| L | H | H | 15 V (3/9 VM) |
| L | H | L | 10 V (2/9 VM) |
| L | L | H | 5 V (1/9 VM) |
| L | L | L | 0 V |

In the first frame, a positive write voltage is applied to the scanning-side electrodes. Therefore, the amplitude of the modulation driving voltage applied to the data-side electrodes is lower as the luminance level is higher, and is higher as the luminance level is lower. In the second frame, a negative write voltage is applied to the scanning-side electrodes. Therefore, the amplitude of the modulation driving voltage applied to the data-side electrodes is higher as the luminance level is higher, and is lower as the luminance level is lower. In Tables 7-1 and 7-2, "-" represents the level which is applied for adjusting the amplitude.

The data-side driver 532 further includes an n-channel FET 706 in parallel to the gate capacitor 704. A gate of the n-channel FET 706 is connected to the ramp wave discharging signal MD. The ramp wave discharging signal MD becomes "H" in a certain period in synchronization with the falling edge of the modulation voltage output signal MO. Then, the FET 706 becomes conductive, and the charge accumulated in the gate capacitor 704 is discharged.

The driving circuit voltage VD which is externally input to the inorganic EL display device 2000 using the DC/DC converter or the like is boosted to +(VW+VM) as a positive DC voltage and −VM as a negative DC voltage by a write power supply circuit 540 included in a write driving power supply circuit 504. The positive and negative DC voltages boosted by the write power supply circuit 540 are supplied to a write pulse generation circuit 541, and are converted into positive and negative pulse-like write voltages in accordance with the control signal supplied from the driving control circuit 501. In this case, "VW" is the light emitting threshold voltage VWa (180 V) of the light emitting layer A, and the driving circuit voltage VD is, for example, 12 V. The write driving power supply circuit 504 outputs a prescribed voltage for discharging the write voltage and is placed in a floating state for a period other than write and discharging. The prescribed voltage has a smaller absolute value than that of the write voltage, and is, for example, 0 V.

Figure 12:
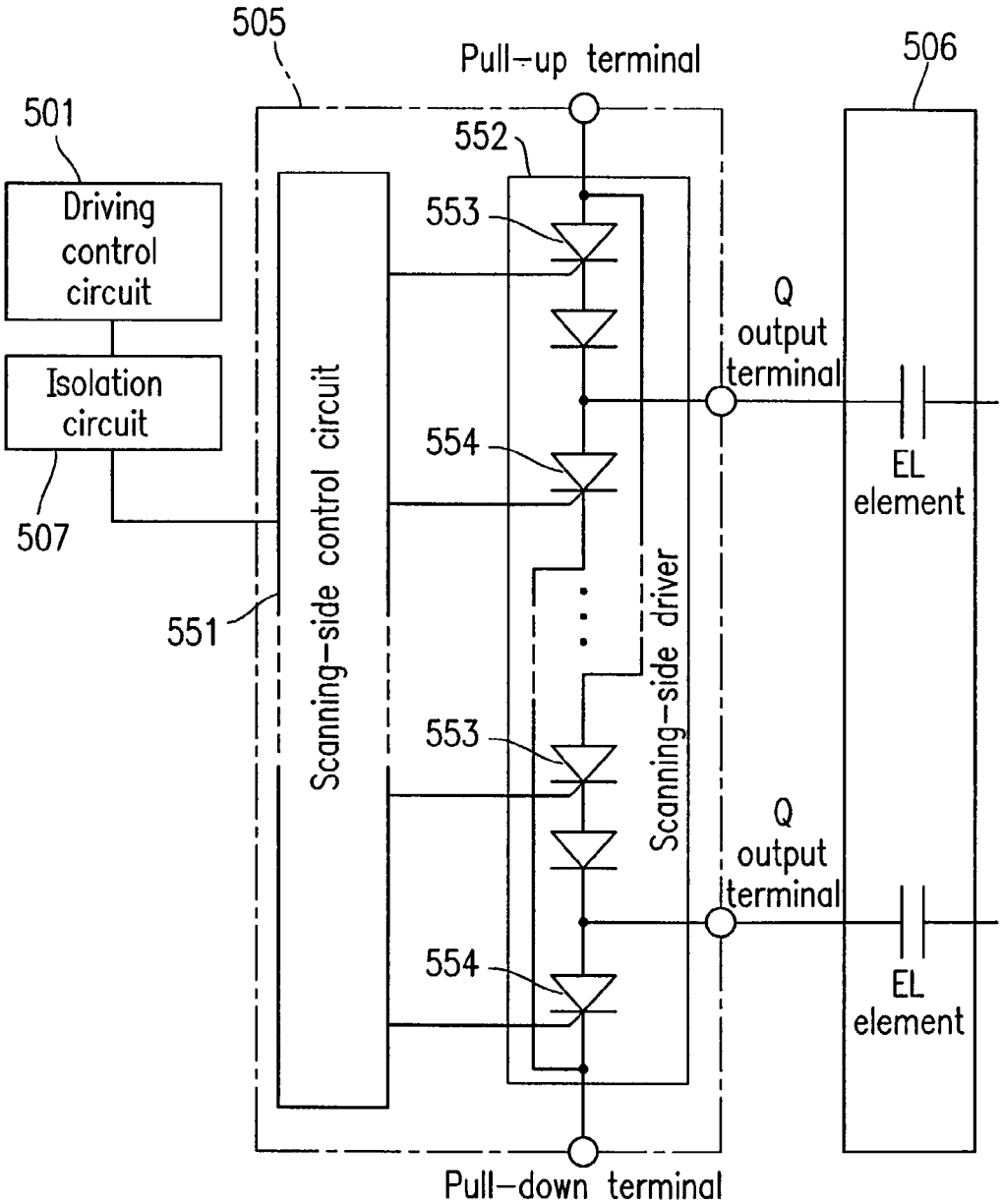
FIG. 12 is a circuit diagram of a scanning-side driving circuit of the inorganic EL display device according to the example of the present invention.

The positive and negative pulse-like write voltages which are generated by the write driving power supply circuit 504 are supplied to a scanning-side driver 552 included in a scanning-side driving circuit 505, respectively via a pull-up line and a pull-down line (FIG. 8). As shown in FIG. 12, the scanning-side driving circuit 505 includes a plurality of switching circuits connected in parallel. The switching circuits are of a push-pull structure and each include a pull-up thyristor 553 and a pull-down thyristor 554. The pull-up line and the Q output terminal have a withstand voltage of about 250 V therebetween, and the Q output terminal and the pull-down line also have a withstand voltage of about 250 V therebetween. The electric potential difference between the pull-up line and the pull-down line changes within a range of about 5 V.

The scanning-side driver 552 is connected to a scanning-side control circuit 551. The scanning-side driver 552 is associated sequentially with the scanning-side electrodes Y1, Y2, . . . , Ym by shift registers (not shown) included in the scanning-side control circuit 151. All the scanning-side electrodes Y1, Y2, . . . , Ym are sequentially scanned. Since the ground potential of the scanning-side control circuit 551 is changed between a positive level and a negative level, the scanning-side control circuit 551 needs to be isolated from the driving control circuit 501. For this purpose, an isolation circuit 507 which includes a photocoupler or the like is provided between the scanning-side control circuit 551 and the driving control circuit 501. Thus, a control signal from the driving control circuit 501 is input to the scanning-side control circuit 551 where the control signal from the driving control circuit 501 and the scanning-side control circuit 551 are isolated from each other.

An exemplary method for driving the inorganic EL display device 2000 having the above-described structure will be described with reference to FIGS. 13A, 13B, 14A and 14B. In this example, the EL elements at the pixel C (FIG.

Figure 13A:
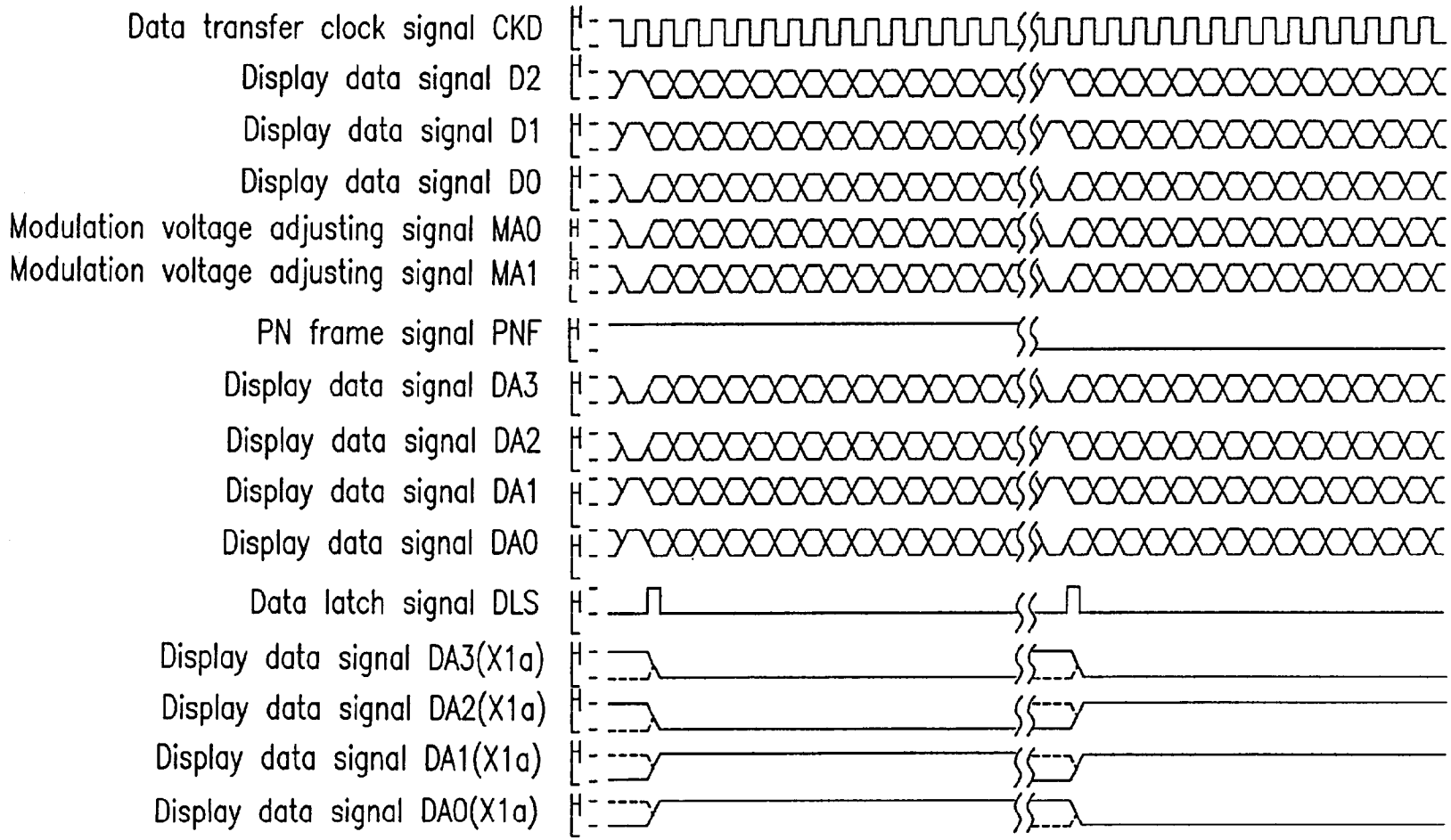
FIG. 13A is a timing diagram illustrating an operation state of the inorganic EL display device according to the example of the present invention for operating a display dot including a light emitting layer A.
Figure 13B:
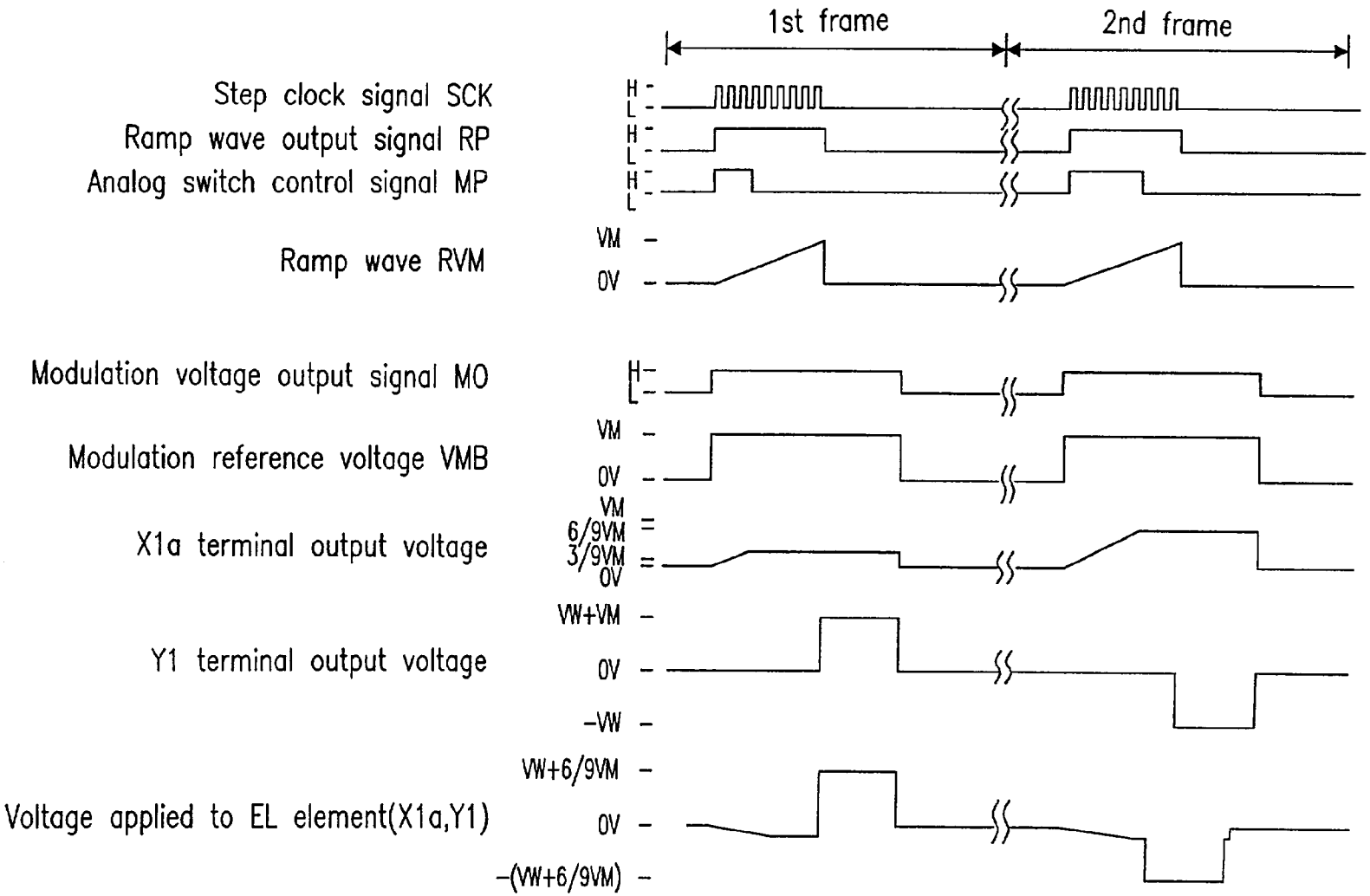
FIG. 13B is a timing diagram illustrating an operation state of the inorganic EL display device according to the example of the present invention for operating a display dot including a light emitting layer A.
Figure 14A:
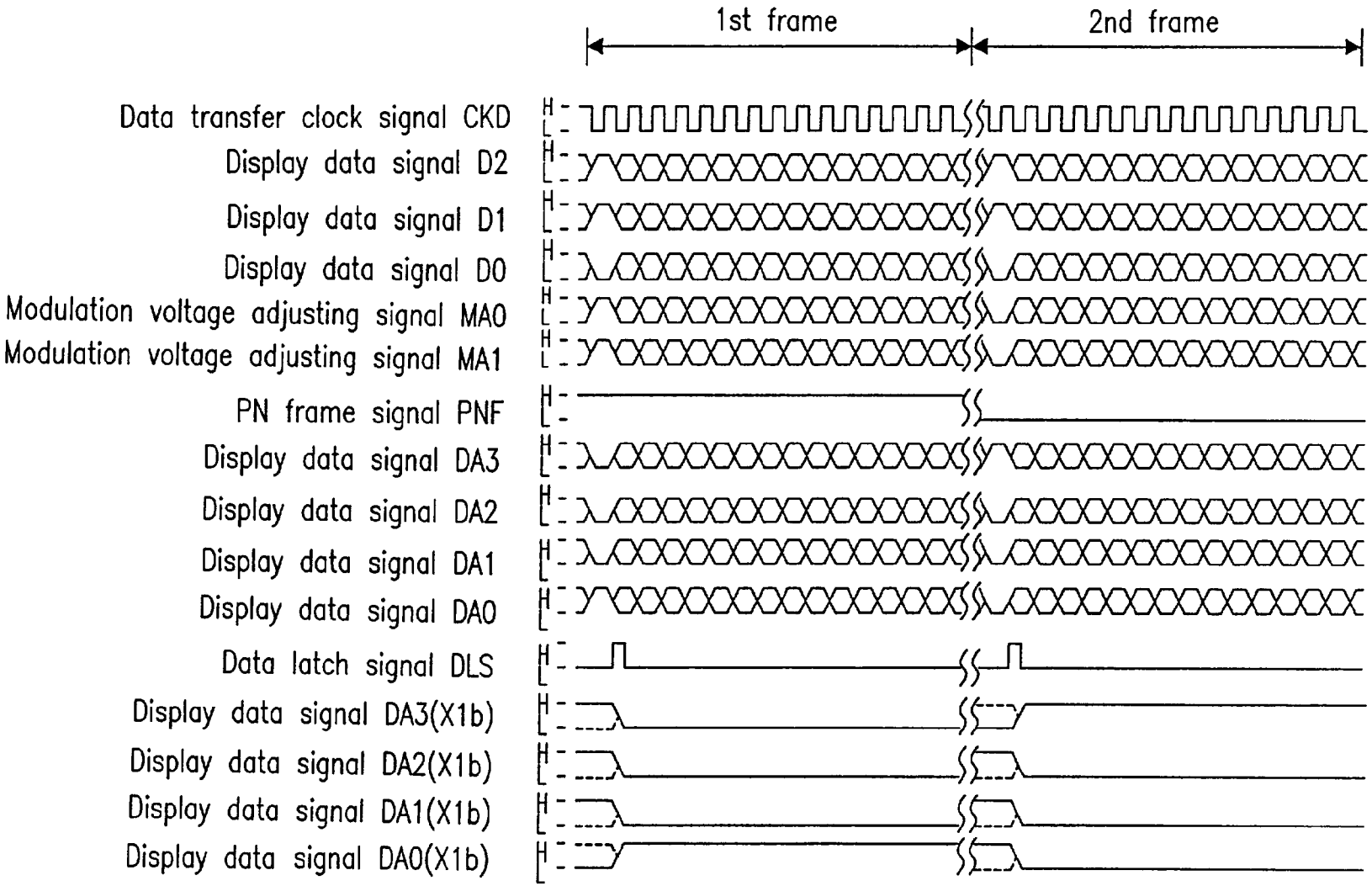
FIG. 14A is a timing diagram illustrating an operation state of the inorganic EL display device according to the example of the present invention for operating a display dot including a light emitting layer B.
Figure 14B:
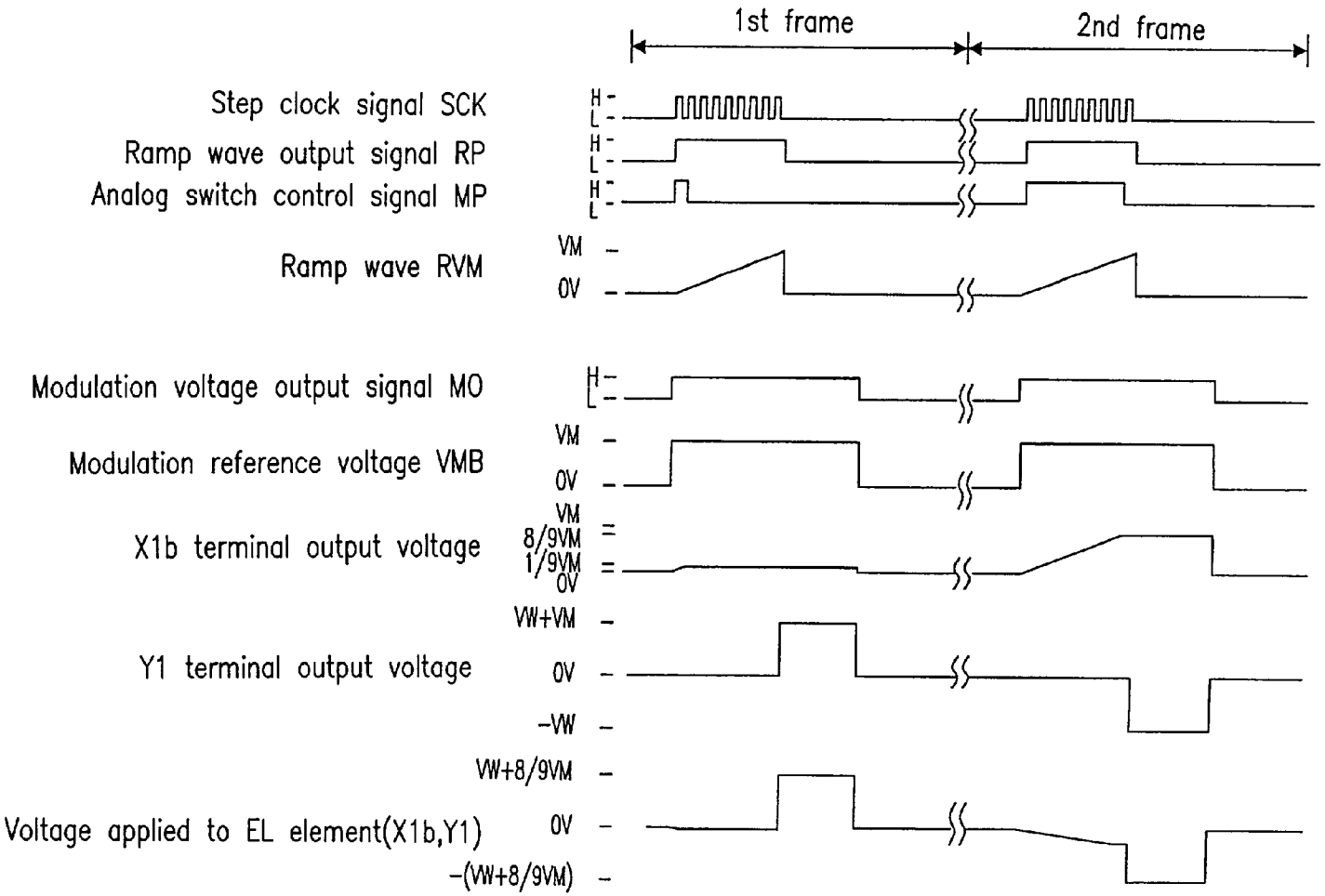
FIG. 14B is a timing diagram illustrating an operation state of the inorganic EL display device according to the example of the present invention for operating a display dot including a light emitting layer B.

8) located at the intersections of the data-side electrodes X1*a* and X1*b* and the scanning-side electrode Y1, i.e., the EL elements (X1*a*, Y1) and (X1*b*, Y1) are caused to emit light at luminance level 6. FIGS. 13A and 13B show exemplary driving of the EL element (X1*a*, Y1), and FIGS. 14A and 14B show exemplary driving of the EL element (X1*b*, Y1). The light emitting layer A is provided at the intersection of the data-side electrode X1*a* and the scanning-side electrode Y1, and the light emitting layer B is provided at the intersection of the data-side electrode X1*b* and the scanning-side electrode Y1.

In the first frame, the display data signals D0 through D2 and, the modulation voltage adjusting signals MA0 and MA1 externally input to the driving control circuit 501 in synchronization with the data transfer clock signal CKD are added together by the adder 508. An exclusive-OR of the resultant sum and the PN frame signal PNF is calculated. The resultant value corresponds to the value obtained by inverting the sum of the display data signals D0 through D2 and the modulation voltage adjusting signals MA0 and MA1. From this resultant value, 6 is subtracted by the subtractor 509. Thus, display data signals DA0 through DA3 are generated and supplied to the data-side driving circuit 503.

The light emitting layer B has a light emission start voltage which is higher than that of the light emitting layer A by two grades. Therefore, as a modulation voltage adjusting signal to the light emitting layer A, "MA0:L, MA1:L" (Table 4) for not shifting the grades is input to the driving control circuit 501. As a modulation voltage adjusting signal to the light emitting layer B, "MA0:H, MA1:H" for shifting the grades by two grades to a higher luminance side is input to the driving control circuit 501. Thus, display data corresponding to each display dot is as shown in Table 8.

TABLE 8

| | MA0 | MA1 | DA3 | DA2 | DA1 | DA0 |
|---|---|---|---|---|---|---|
| (X1a, Y1), light emitting layer A | L | L | L | L | H | H |
| (X1b, Y1), light emitting layer B | H | H | L | L | L | H |

*The same display data signal is externally input to any pixel: (D0: L, D1: H, D2: H).

The data-side driving circuit 503 receives the display data signals DA0 through DA3, the data transfer clock signal CKD, and the data latch signal DLS. The display data signals DA0 through DA3 are transferred to a prescribed position in the shift register and latch circuits 600 (FIG. 9) in the data-side control circuit 531 by the data transfer clock signal CKD. Then, the display data signals DA0 through DA3 are once latched at the rise of the data latch signal DLS. Thus, display data signals DA0(X) through DA3(X) are generated.

All the scanning-side electrodes Y1, Y2, . . . , Ym connected to the scanning-side driving circuit 505 are kept at the floating potential (substantially 0 V). The modulation common voltage line 523 receives the modulation reference voltage pulse VMB in accordance with the modulation voltage output signal MO. The data-side electrodes X1*a*, X1*b*, . . . , Xna and Xnb are each supplied with a modulation voltage of a desired level from the data-side driver 532 in accordance with the analog switch control signal MP and the ramp wave RVM. The analog switch control signal MP is obtained by processing the step clock signal SCK, the ramp wave output signal RP and the display data signals DA0(X) through DA3(X) by the data-side driving control circuit 531. The ramp wave RVM is supplied from the ramp wave line 524.

The data-side driver 532, which is connected to the data-side electrode X1*a* associated with the EL element (X1*a*, Y1) is charged until the gate capacitor 704 is charged to 3/9VM (15 V), the FET 700 is turned ON, and the data-side electrode X1*a* is charged to 3/9VM (15 V). The data-side driver 532, which is connected to the data-side electrode X1*b* associated with the EL element (X1*b*, Y1) is charged until the gate capacitor 704 is charged to 1/9VM (5 V), the FET 700 is turned ON, and the data-side electrode X1*b* is charged to 1/9VM (5 V).

Next, the pulse-like write driving voltage supplied from the write power supply circuit 504, i.e., +(VW+VM) (225 V) is supplied to the selected scanning-side electrode Y1 via the pull-up line and the selected pull-up thyristor 553 in the scanning-side driver 552. Thus, the scanning-side electrode Y1 is charged to +(VW+VM) (225 V).

Therefore, the voltage applied to both of two ends of the EL element (X1*a*, Y1) is +VW+6/9VM (210 V). This value is obtained as a result of the write driving voltage and the modulation voltage being superimposed on each other. The voltage applied to both of two ends of the EL element (X1*b*, Y1) is +VW+8/9VM (220 V). This value is obtained as a result of the write driving voltage and the modulation voltage being superimposed on each other. Therefore, the EL element (X1*a*, Y1) including the light emitting layer A is caused to emit light at luminance level 6, and the EL element (X1*b*, Y1) including the light emitting layer B is also caused to emit light at luminance level 6. (The light emitting layers A and B have the voltage vs. luminance characteristics shown in FIG. 7.)

After the EL elements (X1*a*, Y1) and (X1*b*, Y1) emit light for a prescribed period of time, the scanning-side electrode Y1 is discharged to a prescribed voltage by the selected pull-down thyristor 554 via the pull-down line. The prescribed voltage has a smaller absolute value than that of the write voltage, and is, for example, 0 V. The modulation voltage output signal MO becomes "L", and thus the output of the modulation reference voltage VM to the modulation common voltage line 523 is stopped. The ramp wave charging signal MD becomes "H" for a prescribed period of time, and thus the FET 706 is turned ON so as to discharge the charge accumulated in the gate capacitor 704. Accordingly, the p-channel FET 701 is turned ON so as to discharge the charge accumulated in the EL elements (X1*a*, Y1) and (X1*b*, Y1).

Thus, driving of the selected scanning-side electrode Y1 is terminated. Until being driven in the second frame, the scanning-side electrode Y1 is in a floating state in which the scanning-side electrode Y1 is electrically isolated from the write driving power supply circuit 504. The scanning-side electrodes Y2 through Ym are sequentially driven in a similar manner. Thus, driving in the first frame is completed.

In the second frame, the display data signals D0 through D2 and the modulation voltage adjusting signals MA0 and MA1 externally input to the driving control circuit 501 are added together by the adder 508, so as to generate display data signals DA0 through DA3. The display data signals DA0 through DA3 are output to the data-side driving circuit 503.

The light emitting layer B has a light emission start voltage which is higher than that of the light emitting layer A by two grades. Therefore, as a modulation voltage adjusting signal to the light emitting layer A, "MA0:L, MA1:L"

(Table 4) for not shifting the grades is input to the driving control circuit 501. As a modulation voltage adjusting signal to the light emitting layer B, "MA0:H, MA1:H" for shifting the grades by two grades to a higher luminance side is input. Thus, display data corresponding to each display dot is as shown in Table 9.

TABLE 9

| | MA0 | MA1 | DA3 | DA2 | DA1 | DA0 |
|---|---|---|---|---|---|---|
| (X1a, Y1), light emitting layer A | L | L | L | H | H | L |
| (X1b, Y1), light emitting layer Bfs | H | H | H | L | L | L |

*The same display data signal is externally input to any pixel: (D0: L, D1: H, D2: H).

The data-side driving circuit 503 receives the display data signals DA0 through DA3, the data transfer clock signal CKD, and the data latch signal DLS. The display data signals DA0 through DA3 are transferred to a prescribed position in the shift register and latch circuits 600 (FIG. 9) in the data-side control circuit 531 by the data transfer clock signal CKD. Then, the display data signals DA0 through DA3 are once latched at the rise of the data latch signal DLS. Thus, display data signals DA0(X) through DA3(X) are generated.

All the scanning-side electrodes Y1, Y2, . . . , Ym connected to the scanning-side driving circuit 505 are kept at the floating potential (substantially 0 V). The modulation common voltage line 523 receives the modulation reference voltage pulse VMB in accordance with the modulation voltage output signal MO. The data-side electrodes X1*a*, X1*b*, . . . , Xna and Xnb are each supplied with a modulation voltage of a desired level from the data-side driver 532 in accordance with the analog switch control signal MP and the ramp wave RVM. The analog switch control signal MP is obtained by processing the step clock signal SCK, the ramp wave output signal RP and the display data signals DA0(X) through DA3(X) by the data-side driving control circuit 531. The ramp wave RVM is supplied from the ramp wave line 524.

The data-side driver 532, which is connected to the data-side electrode X1*a* associated with the EL element (X1*a*, Y1) is charged until the gate capacitor 704 is charged to 3/9VM (30 V), the FET 700 is turned ON, and the data-side electrode X1*a* is charged to 6/9VM (30 V). The data-side driver 532, which is connected to the data-side electrode X1*b* associated with the EL element (X1*b*, Y1) is charged until the gate capacitor 704 is charged to 8/9VM (40 V), the FET 700 is turned ON, and the data-side electrode X1*b* is charged to 8/9VM (40 V).

Next, the pulse-like write driving voltage supplied from the write power supply circuit 504, i.e., +(VW+VM) (−225 V) is supplied to the selected scanning-side electrode Y1 via the pull-down line and the selected pull-down thyristor 554 in the scanning-side driver 552. Thus, the scanning-side electrode Y1 is charged to −(VW+VM) (−225 V).

Therefore, the voltage applied to both of two ends of the EL element (X1*a*, Y1) is −VW+6/9VM (−210 V). This value is obtained as a result of the write driving voltage and the modulation voltage being superimposed on each other. The voltage applied to both of two ends of the EL element (X1*b*, Y1) is −(VW−8/9VM) (−220 V). This value is obtained as a result of the write driving voltage and the modulation voltage being superimposed on each other. Therefore, the EL element (X1*a*, Y1) including the light emitting layer A is caused to emit light at luminance level 6, and the EL element (X1*b*, Y1) including the light emitting layer B is also caused to emit light at luminance level 6. (The light emitting layers A and B have the voltage vs. luminance characteristics shown in FIG. 7.)

After the EL elements (X1*a*, Y1) and (X1*b*, Y1) emit light for a prescribed period of time, the scanning-side electrode Y1 is discharged to a prescribed voltage by the selected pull-up thyristor 553 via the pull-up line. The prescribed voltage has a smaller absolute value than that of the write voltage, and is, for example, 0 V. The modulation voltage output signal MO becomes "L", and thus the output of the modulation reference voltage VM to the modulation common voltage line 523 is stopped. The ramp wave charging signal MD becomes "H" for a prescribed period of time, and thus the FET 706 is turned ON so as to discharge the charge accumulated in the gate capacitor 704. Accordingly, the p-channel FET 701 is turned ON so as to discharge the charge accumulated in the EL elements (X1*a*, Y1) and (X1*b*, Y1).

Thus, driving of the selected scanning-side electrode Y1 is terminated. Until being driven in the first frame, the scanning-side electrode Y1 is in a floating state in which the scanning-side electrode Y1 is electrically isolated from the write driving power supply circuit 504. The scanning-side electrodes Y2 through Ym are sequentially driven in a similar manner. Thus, driving in the second frame is completed.

In the above example, the modulation voltage adjusting signals MA0 and MA1 are externally input to the driving control circuit 501, and added to the display data signals D0 through D2. Based on the input signals MA0 and MA1, the adjustable range n is determined. Alternatively, the driving control circuit 501 may have a plurality of sets of built-in modulation voltage adjusting signals MA0 and MA1. In this case, one of the plurality of sets of built-in modulation voltage adjusting signals MA0 and MA1 selected by the driving control circuit 501 may be automatically added to a display data signal corresponding to the predefined light emitting layer. Based on the selected set of built-in modulation voltage adjusting signals MA0 and MA1, the adjustable range n is determined.

The present invention is applicable to a display device including more than two types of light emitting layers, having a greater number of grades than mentioned above, or capable of shifting a greater number of grades than mentioned above.

The present invention is applicable to other types of display devices as well as an inorganic EL display device.

As described above, according to the present invention, even when the same luminance level of display data is input for multiple-grade display, each of a plurality of light emitting layers of an EL element can be supplied with a driving voltage optimized to the characteristic of the respective light emitting layer. Therefore, superb display quality is provided.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A display device, comprising:

a display panel including a plurality of first electrodes, a plurality of second electrodes crossing the plurality of first electrodes, and a plurality of light emitting layers having different light emission characteristics provided in the vicinity of intersections of the plurality of first electrodes and the plurality of second electrodes;

a data-side driving circuit connected to the plurality of first electrodes for supplying a modulation voltage to the plurality of first electrodes;

a modulation driving power supply circuit for supplying a modulation power supply voltage to the data-side driving circuit;

a scanning-side driving circuit connected to the plurality of second electrodes for sequentially supplying a write voltage to the plurality of second electrodes;

a write driving power supply circuit for supplying a write voltage to the scanning-side driving circuit; and a driving control circuit for controlling the data-side driving circuit, the modulation driving power supply circuit, the scanning-side driving circuit, and the write driving power supply circuit, wherein:

gray-scale display is realized by changing an amplitude of the modulation voltage which is output from the data-side driving circuit, the driving control circuit is capable of supplying a first display data signal representing (m+n) grades, obtained by adding m grades represented by a second display data signal externally input and an adjustable range n, so that the modulation voltage having an amplitude corresponding to the light emission characteristic of each of the plurality of light emitting layers is supplied to the corresponding light emitting layer independently of the other light emitting layers, where m is an integer of two or greater and n is an integer of one or greater, the data-side driving circuit is capable of outputting modulation voltages having (m+n) types of amplitudes to the plurality of first electrodes in accordance with the first display data signal, and the amplitude of the modulation voltage corresponding to the light emission characteristic of a prescribed light emitting layer among the plurality of light emitting layers is adjusted to an amplitude in the adjustable range n from the amplitude corresponding to the grade represented by the second display data signal.

2. A display device according to claim 1, wherein the adjustable range n is determined based on a signal input to the driving control circuit.

3. A display device according to claim 1, wherein the adjustable range n is determined based on built-in data in the driving control circuit.

4. A display device, comprising:

a display panel including light emitting elements provided in the vicinity of intersections of data electrodes and scanning electrodes, the light emitting elements of the display panel comprising light emitting elements having a first light emission characteristic and light emitting elements having a second, different light emission characteristic;

a data electrode driving circuit for driving the data electrodes and a scanning electrode driving circuit for driving the scanning electrodes; and a driving control circuit for controlling modulation voltages supplied to the data electrodes by the data electrode driving circuit when a write voltage is supplied to one or more scanning electrodes by the scanning electrode driving circuit so that a first modulation voltage is applied to the light emitting layers having the first light emission characteristic and a second different modulation voltage is applied to the light emitting layers having the second different light emission characteristic, wherein the driving control circuit controls the modulation voltages based at least in part on an arithmetic combination of display data signals specifying m grades of luminance and modulation voltage adjusting signals specifying an adjusting range n of the m grades of luminance, where m is an integer greater than or equal to 2 and n is an integer greater than or equal to 1.

5. The display device according to claim 4, wherein m=8 and n=2.

6. The display device according to claim 4, wherein the driving control circuit comprises:

an adder circuit for adding the display data signals and the modulation voltage adjusting signals;

a logic circuit for logically combining a frame signal and an output of the adder circuit; and a subtractor circuit for performing a subtraction operation involving an output of the logic circuit.

7. The display device according to claim 6, wherein the frame signal has a first logic level in a first frame and a second logic level in a second frame subsequent to the first frame.

8. The display device according to claim 7, wherein in the first frame, a positive write voltage is applied to the one or more of the scanning electrodes, and in the second frame, a negative write voltage is applied to the one or more scanning electrodes.

9. The display device according to claim 4, wherein the modulation voltage adjusting signals are supplied to the driving control circuit from an external source.

10. The display device according to claim 4, wherein the modulation voltage adjusting signals are pre-stored in the driving control circuit.

11. The display device according to claim 4, wherein each pixel of the display panel comprises one light emitting element having the first emission characteristic and one light emitting element having the second emission characteristic.

12. The display device according to claim 4, wherein the data electrode driving circuit comprises an output section including a source follower-type element.

13. The display device according to claim 4, embodied as an inorganic electroluminescence display device.

14. The display device according to claim 4, wherein the first light emission characteristic comprises a first voltage versus luminance characteristic and the second light emission characteristic comprises a second voltage versus luminance characteristic.

15. The display device according to claim 14, wherein the adjusting range is based at least in part on a difference between the first and second voltage versus luminance characteristics.

16. A display device, comprising:

a display panel including light emitting elements arranged in the vicinity of intersections of data electrodes and scanning electrodes, the light emitting elements of the display panel comprising light emitting elements having a first light emission characteristic and light emitting elements having a second, different light emission characteristic;

a data electrode driving circuit for driving the data electrodes and a scanning electrode driving circuit for driving the scanning electrodes; and a driving control circuit for controlling modulation voltages supplied to the data electrodes by the data electrode driving circuit, wherein the driving control circuit comprises circuitry that arithmetically combines display data signals specifying m grades of luminance and modulation voltage adjusting signals specifying an adjusting range n of the m grades of luminance, where m is an integer greater than or equal to 2 and n is an integer greater than or equal to 1, and wherein the controlling of the modulation voltages is based at least in part on the arithmetic combination.

17. The display device according to claim 16, wherein the circuitry that arithmetically combines the display data signals and the modulation voltage adjusting signals comprises an adder circuit.

18. The display device according to claim 17, wherein the driving control circuit further comprises:

logic circuitry for logically combining a frame signal and an output of the adder circuit; and a subtractor circuit for performing a subtraction operation involving an output of the logic circuitry.

19. The display device according to claim 4, wherein the first light emission characteristic comprises a first voltage versus luminance characteristic and the second light emission characteristic comprises a second voltage versus luminance characteristic, and the adjusting range is based at least in part on a difference between the first and second voltage versus luminance characteristics.

* * * * *